US009564137B2

(12) United States Patent
Greer et al.

(10) Patent No.: US 9,564,137 B2
(45) **Date of Patent: *Feb. 7, 2017**

(54) FRAME ERASURE CONCEALMENT FOR A MULTI-RATE SPEECH AND AUDIO CODEC

(71) Applicant: SAMSUNG ELECTRONICS CO., LTD., Suwon-si (KR)

(72) Inventors: Steven Craig Greer, Rowlett, TX (US); Hosang Sung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/069,473

(22) Filed: Mar. 14, 2016

(65) Prior Publication Data

US 2016/0196827 A1 Jul. 7, 2016

Related U.S. Application Data

(63) Continuation of application No. 14/691,191, filed on Apr. 20, 2015, now Pat. No. 9,286,905, which is a (Continued)

(51) Int. Cl.
*G10L 19/02* (2013.01)
*G10L 19/005* (2013.01)

(Continued)

(52) U.S. Cl.
CPC ..... *G10L 19/005* (2013.01); *G10L 19/002* (2013.01); *G10L 19/24* (2013.01)

(58) Field of Classification Search
CPC ..... G10L 19/04; G10L 19/12; H03M 13/09; G06F 15/16

(Continued)

(56) References Cited

U.S. PATENT DOCUMENTS 4,545,052 A * 10/1985 Steierman ..... H04J 3/047 370/466
4,769,833 A * 9/1988 Farleigh ..... H04M 11/068 370/380

(Continued)

FOREIGN PATENT DOCUMENTS

| | | | |
|---|---|---|---|
| JP | 2002-141810 | A | 5/2002 |
| JP | 2012-529243 | A | 11/2013 |
| WO | 2010/141762 | A1 | 12/2010 |

OTHER PUBLICATIONS

Hironori Ito et al., "Performance Evaluation of a packet loss resilience method for AMR speech data transmission over RTP", Multimedia Research Labs., NEC Corporation, 2001, (2 Pages Total).

(Continued)

*Primary Examiner* — Michael Collucci
(74) *Attorney, Agent, or Firm* — Sughrue Mion, PLLC

(57) ABSTRACT

An audio coding terminal and method is provided. The terminal includes a coding mode setting unit to set an operation mode, from plural operation modes, for input audio coding by a codec, configured to code the input audio based on the set operation mode such that when the set operation mode is a high frame erasure rate (FER) mode the codec codes a current frame of the input audio according to a select frame erasure concealment (FEC) mode of one or more FEC modes. Upon the setting of the operation mode to be the High FER mode, the one FEC mode is selected, from the one or more FEC modes predetermined for the High FER mode, to control the codec by incorporating of redundancy within a coding of the input audio or as separate redundancy information separate from the coded input audio according to the selected one FEC mode.

19 Claims, 15 Drawing Sheets

Related U.S. Application Data continuation of application No. 13/443,204, filed on Apr. 10, 2012, now Pat. No. 9,026,434.

(60) Provisional application No. 61/474,140, filed on Apr. 11, 2011.

(51) Int. Cl.
*G10L 19/24* (2013.01)
*G10L 19/002* (2013.01)

(58) Field of Classification Search
USPC ..... 704/270, 230, 229, 227, 222, 219, 207; 455/67.11, 554.2, 552.1, 414.1; 379/386, 379/102.01; 375/259, 242, 346; 370/506, 466, 370/338, 323, 287; 714/807
See application file for complete search history.

(56) References Cited

U.S. PATENT DOCUMENTS 4,885,746 A * 12/1989 Fukushima ..... H04J 3/07 370/506
5,327,520 A * 7/1994 Chen ..... G10L 19/12 704/200
5,717,822 A * 2/1998 Chen ..... G10L 19/12 704/219
5,835,486 A * 11/1998 Davis ..... H04B 3/23 370/287
5,949,822 A * 9/1999 Hancharik ..... H04H 20/55 370/449
5,991,639 A * 11/1999 Rautiola ..... H04Q 11/0478 370/338
6,289,313 B1 * 9/2001 Heinonen ..... G10L 17/26 600/301
6,347,217 B1 * 2/2002 Bengtsson ..... H04B 17/309 370/333
6,510,407 B1 * 1/2003 Wang ..... G10L 19/18 704/207
6,757,860 B2 6/2004 Choi et al.
6,928,267 B2 * 8/2005 Melero ..... H04L 1/20 370/330
7,103,008 B2 * 9/2006 Greenblat ..... G06F 15/78 370/229
7,212,511 B2 * 5/2007 Jonsson ..... H04W 28/06 370/338
7,266,097 B2 * 9/2007 Christodoulides . H04B 7/18513 370/321
7,299,402 B2 * 11/2007 Soong ..... H04L 1/0002 370/522
7,440,399 B2 * 10/2008 Julian ..... H04L 1/1671 370/230
7,502,626 B1 * 3/2009 Lemilainen ..... H04M 1/725 370/351
7,519,535 B2 4/2009 Spindola
7,574,351 B2 8/2009 Anandakumar et al.
7,602,866 B2 * 10/2009 Olsson ..... H04B 1/1027 327/310
7,756,705 B2 7/2010 Lee
8,352,252 B2 1/2013 Fang et al.
2001/0041981 A1 11/2001 Ekudden et al.
2002/0077812 A1 * 6/2002 Suzuki ..... G10L 19/12 704/230
2004/0174984 A1 * 9/2004 Jabri ..... G10L 19/12 379/386
2004/0185785 A1 * 9/2004 Mir ..... H04L 1/0025 455/67.11
2004/0240566 A1 * 12/2004 Sebire ..... H04L 1/0041 375/259
2005/0049853 A1 3/2005 Lee et al.
2005/0060143 A1 3/2005 Ehara
2005/0091047 A1 * 4/2005 Gibbs ..... G10L 19/173 704/219
2005/0137864 A1 * 6/2005 Valve ..... G10L 21/0364 704/227
2005/0154584 A1 7/2005 Jelinek et al.
2005/0228651 A1 10/2005 Wang et al.
2006/0069553 A1 * 3/2006 Hakansson ..... H04L 1/0014 704/222
2006/0173687 A1 8/2006 Spindola
2006/0281485 A1 * 12/2006 Johnson ..... H04L 1/0038 455/552.1
2007/0124494 A1 * 5/2007 Harris ..... H04L 29/06027 709/233
2007/0271101 A1 11/2007 Sato et al.
2009/0070107 A1 3/2009 Kawashima et al.
2009/0248404 A1 * 10/2009 Ehara ..... G10L 19/005 704/219
2010/0161325 A1 * 6/2010 Hellwig ..... H04L 5/1438 704/229
2011/0022924 A1 1/2011 Malenovsky et al.

OTHER PUBLICATIONS

Ingemar Johansson et al.,"Bandwidth efficient AMR operation for VOIP",IEEE Workshop Proceedings on Speech Coding 2002,IEEE,Oct. 6, 2002, (4 Pages Total).
Communication dated Jan. 19, 2016, by the Japanese Patent Office in counterpart Japanese Application No. 2014-505075.
Communication dated Jul. 17, 2014 issued by the European Patent Office in counterpart European Patent Application No. 12771666.0.
Notification of Transmittal of the International Search Report and the Written Opinion of the International Searching Authority, or the Declaration of International Application No. PCT/KR2012/002738 mailed Nov. 28, 2012.
J. Sjoberg et al., "RTP Payload Format and File Storage Format for the Adaptive Multi-Rate (AMR) and Adaptive Multi-Rate Wideband (AMR-WB) Audio Codecs," Network Working Group, Copyright, the IETF Trust 2007, pp. 1-59.
Matt Podolsky et al., "Simulation of FEC-Based Error Control for Packet Audio on the Internet," Dept. of Electrical Engineering and Computer Sciences, University of California, Berkley, all pages.
Jean-Chrysostome Bolot et al., "The Case for FEC-Based Error Control for Packet Audio in the Internet," INRIA B.P.93, 06902 Sophia-Antipolis Cedex, France, {bolot, avega}-@sophia.inria.fr, pp. 1-13.
Vicky Hardman et al., "Reliable Audio for Use over the Internet," pp. 8.
Jean-Chrysostome Bolot et al., "Control Mechanisms for Packet Audio in the Internet," INRIA B.P.93, 06902 Sophia-Antipolis Cedex, France, {bolot,avega-@sophia.inria.fr, pp. 232-239.
Cohn Perkins et al., "A Survey of Packet Loss Recovery Techniques for Streaming Audio," IEEE Network, Sep./Oct. 1998, pp. 40-48.
Cohn Perkins, "Audio and Video for the Internet," Jun. 12, 2003, first 6 pages and pp. 170-219.
Ari Lakaniemi et al., "RTP payload Format for G718 Speech/Audio," Audio Video Transport WG, Apr. 28, 2009, pp. 1-33.
"Overview of 3GPP Release 10 vol. 1.2" Sep. 2011, pp. 1-151.
Kari Jarvinen et al., "Media Coding for the Next Generation Mobile System LTE," Computer Communications 33, 2010, pp. 1916-1927.
"3rd Generation Partnership Project; Technical Specification Group Services and system Aspects; Speech codec Speech Processing Functions; Adaptive Multi-Rate-Wideband (AMR-WB)Speech Codec; Transcoding Functions (Release 9)," 3rd Generation Partnership Project (3GPP) TS 26.190 V9.0.0, Dec. 2009, all pages.
"3rd Generation Partnership Project; Technical Specification Group Services and system Aspects; Speech codec Speech Processing Functions; Adaptive Multi-Rate-Wideband (AMR-WB)Speech Codec; Transcoding Functions (Release 6)," 3rd Generation Partnership Project (3GPP) TS 26.190 V6.1.1, Jul. 2005, all pages.
"3rd Generation Partnership Project; Technical Specification Group Services and system Aspects; Study of Use and Requirements for Enhanced Voice Codecs for the Evolved Packet System (EPS) (Release 10)," 3rd Generation Partnership Project (3GPP) TR 22.813 V10.0.0, Mar. 2010, all pages.

(56) References Cited

OTHER PUBLICATIONS

Communication dated Aug. 9, 2016, issued by the Japanese Patent Office in counterpart Japanese Application No. 2014-505075.

* cited by examiner

FIG. 10

| | Packet N+2 | Packet N+1 (type 3) | Packet N (type 0) | Packet N-1 (onset) | Packet N-2 |
|---|---|---|---|---|---|
| Source | $A_{n+2}$ | $A_{n+1}$ | $A_n$ | $A_{n-1}$ | $A_{n-2}$ |
| | $B_{n+2}$ | $B_{n+1}$ | $B_n$ | $B_{n-1}$ | $B_{n-2}$ |
| | $C_{n+2}$ | $C_{n+1}$ | $C_n$ | $C_{n-1}$ | $C_{n-2}$ |
| Redundancy | | $A_{n-1}$ | $A_{n-1}$ | | |
| | | $B_{n-1}$ | $B_{n-1}$ | | |
| | | $C_{n-1}$ | $C_{n-1}$ | | |

FRAME ERASURE CONCEALMENT FOR A MULTI-RATE SPEECH AND AUDIO CODEC

CROSS-REFERENCE TO RELATED APPLICATIONS

This is a continuation application of U.S. patent application Ser. No. 14/691,191, filed on Apr. 20, 2015, which is a continuation of U.S. patent application Ser. No. 13/443,204, filed on Apr. 10, 2012 and issued as U.S. Pat. No. 9,286,905 on Mar. 15, 2016, which claims the benefit of Provisional Application No. 61/474,140, filed Apr. 11, 2011, in the U.S. Patent and Trademark Office, the disclosures of which are incorporated herein by reference.

BACKGROUND

1. Field

One or more embodiments relate to technologies and techniques for encoding and decoding audio, and more particularly, to technologies and techniques for encoding and decoding audio with improved frame error concealment using a multi-rate speech and audio codec.

2. Description of the Related Art

In the technical field of speech and audio coding for environments where frames of encoded speech or audio are expected to be subjected to occasional losses during their transport, coded speech and audio transporting or decoding systems are designed to limit frame losses to the order of a few percent.

To limit these frame losses, or to compensate for the loss of frames, frame erasure concealment (FEC) algorithms may be implemented by a decoding system independent of the speech codec used to encode or decode the speech or audio. Many codecs use decoder-only algorithms to reduce the degradation caused by frame loss.

Such FEC algorithms have recently been utilized in cellular communication networks or environments, which operate in accordance with a given standard or specification. For example, the standard or specification may define the communication protocols and/or parameters that shall be used for a connection and communication. Examples of the different standards and/or specifications include Global System for Mobile Communications (GSM), GSM/Enhanced Data rates for GSM Evolution (EDGE), American Mobile Phone System (AMPS), Wideband Code Division Multiple Access (WCDMA) or 3rd generation (3G) Universal Mobile Telecommunications System (UMTS), International Mobile Telecommunications 2000 (IMT 2000), for example. Here, speech coding has previously been performed with either variable rate or fixed rate encoding. In variable rate encoding, the source uses an algorithm to classify speech into different rates, and encodes the classified speech according to respective predetermined bit rates. Alternatively, speech coding has been performed using fixed bit rates, where detected voice speech audio may be coded according to a fixed bit rate. An example of such fixed rate codecs include multi-rate speech codecs developed by the 3rd Generation Partnership Project (3GPP) for GSM/EDGE and WCDMA communication networks, such as the adaptive multi-rate (AMR) codec and the adaptive multi-rate wideband (AMR-WB) codec, which code the speech according to such detected voice information, and further based upon factors such as the network capacity and radio channel conditions of the air interface. The term multi-rate refers to fixed rates being available depending on the mode of operation of the codec. For example, AMR contains eight available bit-rates from 4.7 kbit/s to 12.2 kbit/s for speech, while AMR-WB contains nine bit-rates from 6.6 kbit/s to 23.85 kbit/s for speech. The specifications of the AMR and AMR-WB codecs are respectively available in the 3GPP TS 26.090 and 3GPP TS 26.190 technical specifications for the third generation of the 3GPP wireless systems, and voice detection aspect of the AMR-WB can be found in the 3GPP TS 26.194 technical specification for the third generation of the 3rd 3GPP wireless systems, the disclosures of which are incorporated herein.

In such cellular environments, for example, losses may be due to interference in a cellular radio link or router overflow in an IP network, for example. Currently, a new fourth generation of the 3GPP wireless system is currently being developed, known as Enhanced Packet Services (EPS), with a primary air interface for EPS being referred to as Long Term Evolution (LTE). As an example, FIG. 1 illustrates EPS 10, with a speech media component 12, wherein voice data is coded according to an example AMR-WB codec for wideband speech audio data and the AMR codec for narrowband speech audio data, this AMR may also be referred to as AMR Narrowband (AMR-NB). EPS 10 conforms to UMTS and LTE voice codecs in 3GPP Release 8 and 9, for example. The UMTS with LTE voice codecs in the 3GPP Releases 8 and 9 may also be referred to as Multimedia Telephony Service for IP Multimedia Core Network Subsystem (IMS) over EPS in the 3GPP Releases 8 and 9, which are the first releases for the fourth generation of the 3rd 3GPP wireless systems. IMS is an architectural framework for delivering Internet Protocol (IP) multimedia services.

Even though LTE has been developed in view of the potential transmission interference and failing in cellular or wireless networks, speech frames transported in 3GPP cellular networks will still be subject to erasure, with a small percentage of frames and/or packets being lost during transmission. Erasure is a classification, e.g., by a decoder, for the decoder to assume information of that packet has been lost or unusable. In the case of the EPS network, for example, frame erasures may still be expected. To address the erased frames, the decoder will typically implement frame error concealment (FEC) algorithms to mitigate the impact of the corresponding lost frames.

Some FEC approaches use only the decoder to address the concealment of the erased frame, i.e., the lost frame. For example, the decoder is aware or is made aware that a frame erasure has occurred, and estimates the contents of the erased frame from known good frames that arrive at the decoder just before and sometimes also just after the erased frame.

A feature of some 3GPP cellular networks is the ability to identify and notify the receiving station of frame erasures that take place. Therefore, the speech decoder knows whether a received speech frame is to be considered a good frame or considered an erased frame. Due to the nature of speech and audio, a small percentage of frame erasures can be tolerated if proper frame erasure mitigation or concealment measures are put in place. Some FEC algorithms may merely substitute noise in place of the lost packet, silence, some type of fading out/in, or some type of interpolation, for example, to help make the loss of the frame less noticeable.

Alternate FEC approaches include having the encoder send specific information in a redundant fashion. For example, the ITU Telecommunication Standardization Sector G.718 (ITU-T G.718) standard, incorporated herein by reference, recommends sending redundant information pertaining to a core encoder output, in an enhancement layer. This enhancement layer could be sent in a different packet from the core layer.

SUMMARY

In one or more embodiments, there is provided a terminal, including a coding mode setting unit to set a mode of operation, from plural modes of operation, for coding by a codec of input audio data, and the codec configured to code the input audio data based on the set mode of operation such that when the set mode of operation is a high frame erasure rate (FER) mode of operation the codec codes a current frame of the input audio data according to one frame erasure concealment (FEC) mode of one or more FEC modes, wherein, upon the coding mode setting unit setting the mode of operation to be the High FER mode of operation, the coding mode setting unit selects the one FEC mode, from the one or more FEC modes predetermined for the High FER mode of operation, to control the codec based on an incorporating of redundancy within a coding of the input audio data or as separate redundancy information separate from the coded input audio according to the selected one FEC mode.

The coding mode setting unit may perform the selecting of the one FEC mode from the one or more FEC modes for each of plural frames of the input audio data.

The High FER mode of operation may be a mode of operation for an Enhanced Voice Services (EVS) codec of a 3GPP standard and the codec may be the EVS codec, wherein, when the EVS codec encodes audio of a current frame, the EVS codec adds encoded audio from at least one neighboring frame, including respectively encoded audio of one or more previous frames and/or one or more future frames, to results of the encoding of the current frame in a current packet for the current frame as combined EVS encoded source bits, with the combined EVS encoded source bits being represented in the current packet distinct from any RTP payload portion of the current packet, and wherein the EVS codec may be configured to respectively encode audio from each of the at least one neighboring frame, as the encoded audio, and include the respectively encoded audio from each of the at least one neighboring frame in separate packets from the current packet.

At least one of the one or more FEC modes may control the codec to code the current frame and neighboring frames according to selectively different fixed bit rates and/or different packet sizes, control the codec to code the current frame and neighboring frames according to same fixed bit rates, or control the codec to encode the current frame and neighboring frames according to same packet sizes, wherein each of the at least one FEC mode of the one or more FEC modes controls the codec to divide the current frame into sub-frames, calculate respective numbers of codebook bits for each sub-frame based on the sub-frame being coded according to a bit rate less than the same fixed bit rate, and encode the sub-frame using the same fixed bit rate with the respective number of codebooks bits being used to define codewords for the bits of the sub-frame.

The EVS codec may be configured to provide unequal redundancy for bits of the current frame based on the division of the bits of the current frame into the sub-frames, including at least a first and second sub-frame, and to add results of an encoding of the bits of the current frame classified in the first sub-frame to respective one or more neighboring packets differently from any adding of results of an encoding of the bits of the current frame classified into the second sub-frame neighboring packets.

The EVS codec may be configured to provide unequal redundancy for linear prediction parameters of the current frame based on the division of the bits of the current frame into the sub-frames, including at least a first and second sub-frame, and to add linear prediction parameter results of an encoding of the bits of the current frame classified in a first sub-frame to respective one or more neighboring packets differently from any adding of linear prediction parameter results of an encoding of the bits of the current frame classified into the second sub-frame in neighboring packets.

The codec may be further configured to add a High FER mode flag to the current packet for the current frame to identify the set mode of operation for the current frame as being the High FER mode of operation, wherein the High FER mode flag may be represented in the current packet by a single bit in the RTP payload portion of the current packet. The codec may be further configured to add a FEC mode flag to the current packet for the current frame identifying which one of the one or more FEC modes was selected for the current frame, wherein the FEC mode flag may be represented in the current packet by a predetermined number of bits, as only an example, and wherein the codec codes the FEC mode flag for the current frame with redundancy in packets of different frames. As only an example, in one embodiment, the predetermined number of bits could be 2, though alternative embodiments are equally available.

The High FER mode of operation may be a mode of operation for an Enhanced Voice Services (EVS) codec of a 3GPP standard and the codec may be the EVS codec, wherein the EVS codec may be further configured to decode a High FER mode flag in at least the current packet to identify the set mode of operation for the current frame as being the High FER mode of operation, and upon detection of the High FER mode flag, decode a FEC mode flag for the current frame from the current packet identifying which one of the one or more FEC modes was selected for the current frame, wherein the coding of the input audio data may be a decoding of the input audio data according to the selected FEC mode, and wherein, when the EVS codec may be decoding the input audio data, encoded redundant audio from at least one neighboring frame are parsed from the current packet, including respectively encoded audio of one or more previous frames and/or one or more future frames to the current frame, and decoding a lost frame from the one or more previous frames and/or one or more future frames based on the respectively parsed encoded redundant audio in the current packet.

Here, the EVS codec may be configured to decode the current frame based on unequal redundancy for bits or parameters for the current frame within the input audio data, wherein the unequal redundancy may be based on a previous classification of the bits or parameters of the current frame into at least first and second categories, and an adding of results of an encoding of the bits or parameters of the current frame classified in the first category to respective one or more neighboring packets as respective redundant information differently from any adding of results of an encoding of the bits or parameters of the current frame classified into the second category in neighboring packets as respective redundant information, wherein the coding of the current frame includes decoding the current frame based on decoded audio of the current frame from the one or more neighboring packets when the current frame is lost.

The High FER mode of operation may be a mode of operation for an Enhanced Voice Services (EVS) codec of a 3GPP standard and the codec may be the EVS codec, wherein the EVS codec may be further configured to decode a High FER mode flag in at least the current packet to identify the set mode of operation for the current frame as being the High FER mode of operation, and upon detection of the High FER mode flag, decode a FEC mode flag for the current frame from the current packet identifying which one of the one or more FEC modes was selected for the current frame, and wherein the coding of the input audio data may be an encoding of the input audio data according to the selected FEC mode, wherein the EVS codec may be configured to decode the current frame based on unequal redundancy for bits or parameters for the current frame within the input audio data, wherein the unequal redundancy may be based on a previous classification of the bits or parameters of the current frame into at least first and second categories, and an adding of results of an encoding of the bits or parameters of the current frame classified in the first category to respective one or more neighboring packets unequally from any adding of results of an encoding of the bits or parameters of the current frame classified into the second category in neighboring packets, and wherein the coding of the current frame includes decoding the current frame based on decoded audio for the current frame from the one or more neighboring packets when the current frame is lost.

Here, the EVS codec may be configured to provide unequal redundancy for bits or parameters of the current frame by classifying the bits of the current frame into at least a first and second categories, and to add results of an encoding of the bits of the current frame classified in the first category to respective one or more neighboring packets differently from any adding of results of an encoding of the bits of the current frame classified into the second category in neighboring packets.

The EVS codec may be configured to provide unequal redundancy for linear prediction parameters of the current frame by classifying the bits or parameters of the current frame into at least a first and second categories, and to add linear prediction parameter results of an encoding of the bits or parameters of the current frame classified in the first category to respective one or more neighboring packets differently from any adding of linear prediction parameter results of an encoding of the bits or parameters of the current frame classified into the second category in neighboring packets.

The codec may encode audio of a current frame, the codec adds encoded audio from at least one neighboring frame, including respectively encoded audio of one or more previous frames and/or one or more future frames, to a frame error concealment (FEC) portion of a current packet for the current frame distinct from a codec encoded source bits portion of the current packet including results of the encoding of the current frame, with the codec encoded source bits portion of the current packet and the FEC portion of the current packet each being represented in the current packet distinct from any RTP payload portion of the current packet, and wherein the codec may be configured to respectively encode audio from each of the at least one neighboring frame, as the encoded audio, and include the respectively encoded audio from each of the at least one neighboring frame in separate packets from the current packet.

The codec may be configured to provide redundancy for bits of at least one neighboring frame by adding respective results of encodings of the bits of at least one neighboring frame to the current packet as separate distinct FEC portions. Further, the separate packets may not be contiguous.

The coding mode setting unit may set the mode of operation to be the FER mode of operation with different, increased, and/or varied redundancy compared to remaining modes of operation of the plural modes of operation for non-FER modes of operation, based upon an analysis of feedback information available to the terminal based upon one or more determined qualities of transmissions outside the terminal and/or a determination of the current frame in the input audio data being more sensitive to frame erasure upon transmission or having greater importance over other frames of the input audio data.

The feedback information may include at least one of: fast feedback (FFB) information, as hybrid automatic repeat request (HARQ) feedback transmitted at a physical layer; slow feedback (SFB) information, as fed back from network signaling transmitted at a layer higher than the physical layer; in-band feedback (ISB) information, as in-band signaling from the a codec at a far end; and high sensitivity frame (HSF) information, as a selection by the codec of specific critical frames to be sent in a redundant fashion.

The terminal may receive at least one of the FFB information, the HARQ feedback, the SFB information, and ISB information and perform the analysis of the received feedback information to determine the one or more qualities of transmission outside the terminal.

The terminal may receive information indicating that the analysis of at least one of the FFB information, the HARQ feedback, the SFB information, and ISB information has been previously performed based upon a received flag in a packet indicating that the current frame in the current packet is coded according the High FER mode or indicating that an encoding of the current packet should be performed by the codec in the High FER mode.

The coding mode setting unit may set the mode of operation to be at least one of the one or more FEC modes based upon one of a determined coding type of the current frame and/or neighboring frames, from plural available coding types, or a determined frame classification of the current frame and/or neighboring frames, from plural available frame classifications.

The plural available coding types may include an unvoiced wideband type for unvoiced speech frames, a voiced wideband type for voiced speech frames, a generic wideband type for non-stationary speech frames, and a transition wideband type used for enhanced frame erasure performance. The plural available frame classifications may include an unvoiced frame classification for unvoiced, silence, noise, voiced offset, an unvoiced transition classification for transition from unvoiced to voiced components, a voiced transition classification for transition from voiced to unvoiced components, a voiced classification for voiced frames and the previous frame was also a voiced or classified as an onset frame, and an onset classification for voiced onset being sufficiently well established to follow with a voice concealment by a decoder.

In one or more embodiments, there is provided a codec coding method, including setting a mode of operation, from plural modes of operation, for coding input audio data, coding the input audio data based on the set mode of operation such that when the set mode of operation is a high frame erasure rate (FER) mode of operation the coding includes coding a current frame of the input audio data according to one frame erasure concealment (FEC) mode of one or more FEC modes, wherein, upon the setting of the mode of operation to be the High FER mode of operation, selecting the one FEC mode, from the one or more FEC modes predetermined for the High FER mode of operation, and coding the input audio data based on an incorporating of redundancy within a coding of the input audio data or as separate redundancy information separate from the coded input audio according to the selected one FEC mode.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

BRIEF DESCRIPTION OF THE DRAWINGS

These and/or other aspects will become apparent and more readily appreciated from the following description of embodiments, taken in conjunction with the accompanying drawings of which:

FIG. 10 illustrates various packet subtypes providing enhanced protection to an onset frame, according to one or more embodiments;

DETAILED DESCRIPTION

Figure 1:
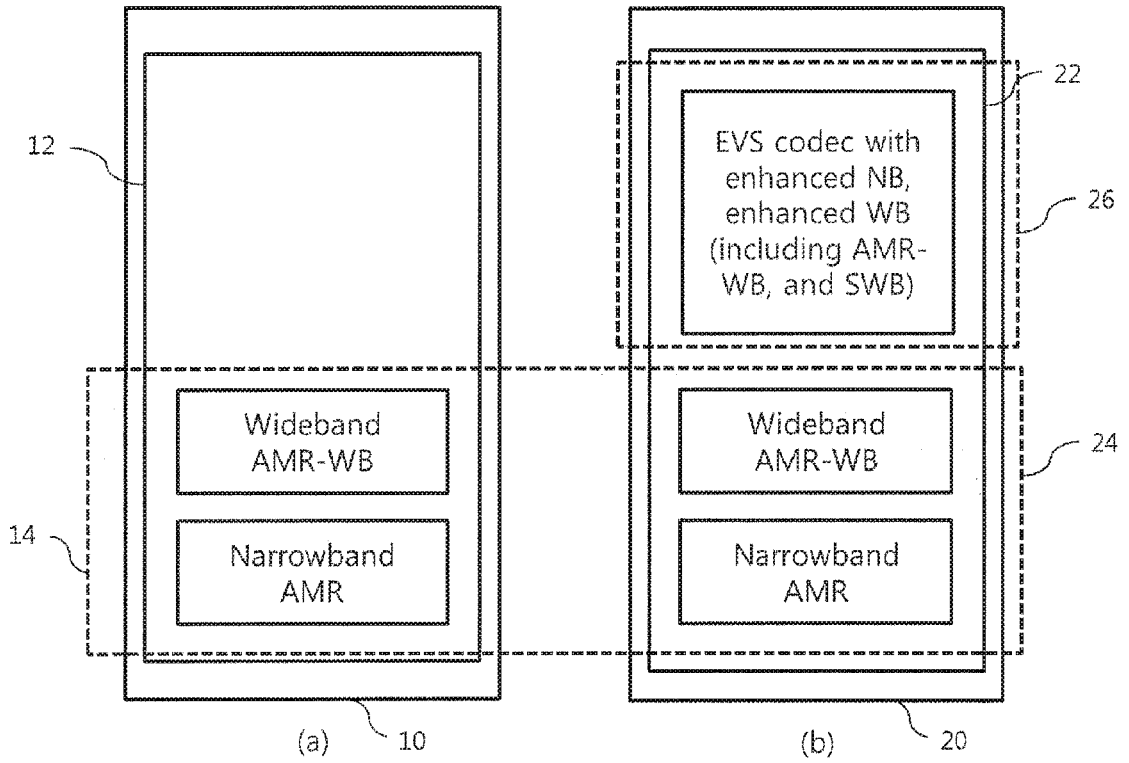
FIG. 1 illustrates an Evolved Packet System (EPS) 20, including an Enhanced Voice Service (EVS) codec, according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

One or more embodiments relate to the technical field of speech and audio coding wherein frames of encoded speech or audio may be subjected to occasional losses during their transport. Losses can be due to interference in a cellular radio link or router overflow in an IP network, as only examples.

Here, though embodiments may be discussed regarding one or more EVS codecs for future adoption within the fourth generation of the 3GPP wireless system architecture, embodiments are not limited to the same.

3GPP is in the process of standardizing a new speech and audio codec for future cellular or wireless systems. This codec, known as the Enhanced Voice Services (EVS) codec, is being designed to efficiently compress speech and audio into wide range of encoded bit rates for 3GPP's fourth generation network known as Enhanced Packet Services (EPS). One key feature of EPS is the use of packet-based transport for all services including those of speech and audio, including over the EPS air interface, known as Long Term Evolution (LTE). The EVS codec is designed to operate efficiently in a packet-based environment.

The EVS codec will have the capability to compress audio bandwidths from narrowband up to full-band, in addition to stereo capability, and could be viewed as an eventual replacement for existing 3GPP codecs. The motivation for a new codec in 3GPP include advancement of speech and audio coding algorithms, expected new applications requiring higher audio bandwidths and stereo, and the migration of speech and audio services from a circuit-switched to packet-switched environment.

A key aspect of the environment for which the EVS codec will operate, as is the case with previous 3GPP-based networks, is the loss of speech/audio frames as they are transported from the sender to the receiver. This is an expected consequence of transport in a cellular network and is taken into account during the design of speech and audio codecs designed to operate in such environments. The EVS codec is no exception and will also include algorithms to minimize the impact of the loss of frames of speech or frame erasures. EPS, as well as the legacy 3GPP cellular networks, is designed to maintain a reasonable frame erasure rate for most users during normal conditions.

It is envisioned herein that the EVS codec, such as the EVS codec 26 of FIG. 1, will find use not only in 3GPP applications, but also those beyond 3GPP where packet loss conditions could be less, similar, or worse than those of the 3GPP networks. In addition, even in EPS there will be some users, in some conditions who will experience a higher than normal rate of frame erasures, i.e., higher than envisioned for EVS. To address these concerns, there is proposed a high frame erasure rate (FER) mode for the EVS codec, wherein additional resources (additional bit rate, and or delay) could be used to provide additional frame loss mitigation under special circumstances.

This High FER mode may address frame erasure rates that are at the extreme of operating conditions in LTE, for example. The High FER mode would trade off additional resources (bit rate, delay) in return for better performance in frame erasure rates on the order of 10% or higher.

One or more embodiments are directed to a frame erasure concealment (FEC) framework for this High FER mode of the EVS codec 26, as only an example. One or more embodiments propose a redundancy scheme wherein various encoded parameters of a speech frame are transmitted with varying redundancy based on the importance of the particular parameter. In addition, FEC bits generated at the encoder, but not part of the encoded speech, may also be prioritized and transmitted with varying redundancy. Redundancy is achieved through repetition of some or all of the bits in multiple packets, and depending on embodiment is performed in an unequal manner between frames or within frames.

FIG. 1 illustrates an Evolved Packet System (EPS) 20, including an Enhanced Voice Service (EVS) codec 26 and Voice Service codec 24, for a fourth generation of the 3GPP within speech media component 22. The EVS codec 26 may operate efficiently over the example LTE air interface. As only an example, this efficient design may match the various codec frame sizes and RTP payload to the transport block sizes that have already been defined for LTE. The EVS codec 26 may be a multi-rate and multi-bandwidth codec that will operate in an environment where frame losses may or will occur (wireless air interface and VoIP network). Therefore, according to one or more embodiments, the EVS codec 26 includes frame erasure concealment (FEC) algorithms to mitigate the impact of frame loss.

In audio coding FEC approaches have previously been implemented by the decoding system independent of the speech codec used to encode or decode the speech or audio. However, a potentially more effective approach, if there is the opportunity, is to design FEC algorithms into the EVS codec 26 during the development phases of the decoder side of the EVS codec 26. On the encoder side, the encoders have also typically only provided redundancies in data independent of the underlying codec being implemented to encode the speech of audio data. Thus, though previous codecs have used decoder-only algorithms to reduce the degradation caused by frame loss, a potentially more effective approach, albeit at the additional cost of system bandwidth and potentially delay, proposed herein is to incorporate FEC algorithms into at least the encoder side of the EVS codec 26, e.g., during the development phases of the encoder side of the EVS codec 26, according to one or more embodiments. One or more embodiments may include FEC algorithms applied by the encoder, as well as appropriate FEC algorithms of the decoder to conceal errors or lost packets, and may also be used in combination with additional frame error concealment algorithms or approaches of the decoder to adequately reconstruct erred bit(s) or lost packets, e.g., for the maintenance of proper timing in the decoded audio data and potentially with audio characteristics that are less noticeable as being erred or lost, or for identical reconstruction. Accordingly, the EVS codec 26 may implement both the previously discussed approaches to frame loss concealment, as well as aspects of the FEC framework discussed herein.

Accordingly, one or more embodiments involve at least encoder-based FEC algorithms, such in a fourth generation 3GPP wireless system, with one or more embodiments including an encoder and/or decoder that can perform respective encoding and decoding operations.

Figure 2A:
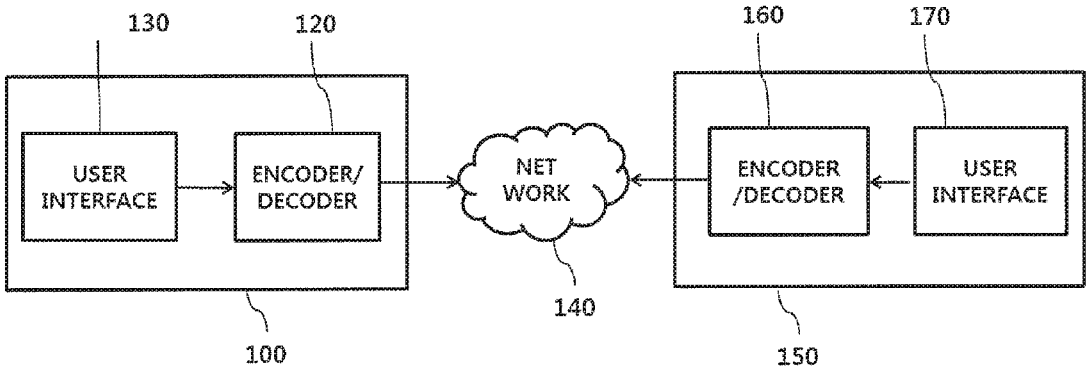
FIG. 2A illustrates an encoding terminal 100, one or more networks 140, and a decoding terminal 150, according to one or more embodiments.

FIG. 2A illustrates an encoding terminal 100, one or more networks 140, and a decoding terminal 150. In one or more embodiments, the one or more networks 140 also include one or more intermediary terminals, which may also include the EVS codec 26 and perform encoding, decoding, or transformation, as needed. The encoding terminal 100 may include an encoder side codec 120 and a user interface 130, and the decoding terminal 150 may similarly include a decoder side codec 160, and user interface 170.

Figure 2B:
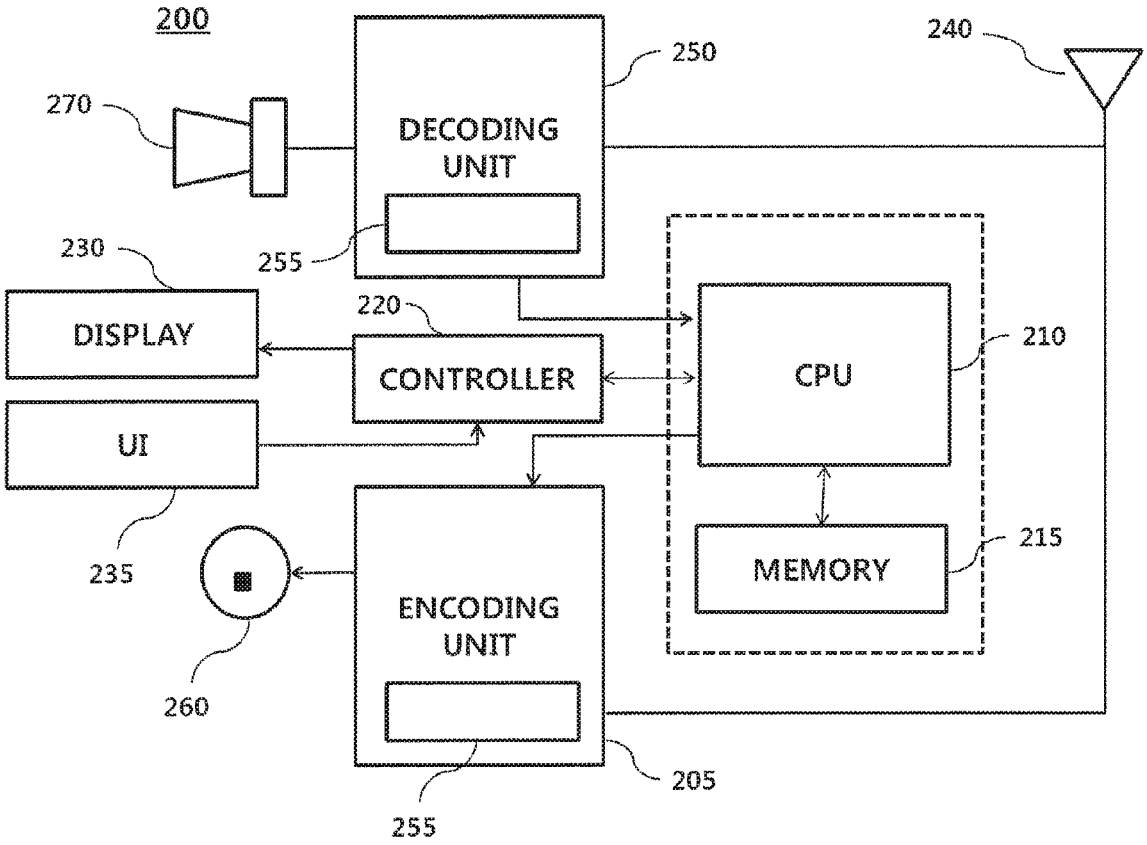
FIG. 2B illustrates a terminal 200 including an EVS codec, according to one or more embodiments.

FIG. 2B illustrates a terminal 200, which is representative of one or both of the encoding terminal 100 and the decoding terminal 150 of FIG. 2A, as well as any intermediary terminals within the one or more networks 140, according to one or more embodiments. The terminal 200 includes a encoding unit 205 coupled to an audio input device, such as a microphone 260, for example, a decoding unit 250 coupled to an audio output device, such as a speaker 270, and potentially a display 230 and input/output interface 235, and processor, such as central processing unit (CPU) 210. The CPU 210 may be coupled to the encoding unit 205 and the decoding unit 250, and may control the operations of the encoding unit 205 and the decoding unit 250, as well as the interactions of other components of the terminal 200 with the encoding unit 205 and decoding unit 250. In an embodiment, and only as an example, the terminal 200 may be mobile device, such as a mobile phone, smart phone, tablet computer, or personal digital assistant, and the CPU 210 may implement other features of the terminal and capabilities of the terminal for customary features in mobile phones, smart phones, tablets computes, or personal digital assistants, as only examples.

As an example, the encoding unit 205 digitally encodes input audio based on an FEC algorithm or framework, according to one or more embodiments. Stored codebooks may be selectively used based upon the FEC algorithm applied, such as codebooks stored the memories of the encoding unit 205 and decoding unit 250. The encoded digital audio may then be transmitted in packets modulated onto a carrier signal and transmitted by an antenna 240. The encoded audio data may also be stored for later playback in the memory 215, which can be non-volatile or volatile memory, for example. The encoded digital audio may then be transmitted in packets modulated onto a carrier signal and transmitted by an antenna 240. As another example, the decoding unit 250 may decoded input audio based on an FEC algorithm of one or more embodiments. The audio being decoded by the decoding unit 250 may be provided from the antenna 240, or obtained from memory 215 as the previously stored encoded audio data. In addition, stored codebooks may be stored in the memories of the encoding unit 205 and decoding unit 250, or in memory 215, and selectively used based upon the FEC algorithm applied, in one or more embodiments. As noted, depending on embodiment, the encoding unit 205 and the decoding unit 250 each include a memory, such as to store the appropriate codebooks and the appropriate codec algorithm or FEC algorithm. The encoding unit 205 and decoding unit 250 may be a single unit, e.g., together representing same use of an included processing device as the codec that is used to either encoding and/or decoding audio data. In an embodiment, the processing device is configured to perform encoding and/or decoding codec processing in parallel for different portions of input audio or different audio streams.

The terminal 200 further sets forth codec mode setting units 255 which select from plural available modes of operation of the encoding unit 205 and/or decoding unit 250. Each codec mode setting unit 255, considering there may could be one codec mode setting unit for both of the encoding unit 205 and decoding unit 250. The EVS codec can encode both speech and music with the same modes of operation. Further, if the input audio is non-speech audio then the encoding unit 205 or decoding unit 250 may encode or decode, respectively, for music or greater fidelity audio, for example. If the input audio is speech audio, then the codec mode setting unit may determine which of plural modes of operation the encoding unit 205 or decoding unit 250 should operate to encode or decode, respectively, the audio data. If the codec mode setting units 255 detect that a High FER mode of operating is determined, then one of one or more of FEC modes will be selected by the codec mode setting units 255 for operating within the High FER mode of operation. Though other modes of operation available for speech coding are not implemented, due to the setting of the mode of operation to the High FER mode of operation, the FEC modes may incorporate the use of the other speech coding modes within the FEC framework discussed herein. The codec mode setting units 255 may also perform parsing of encoded input packets to parse out information identifying whether received encoded audio is speech, the mode of operation for non-speech audio, whether the High FER mode is set, any potential one or more FEC modes of operation for the FER mode, etc. The codec mode setting units 255 may also add this information to packets of encoded output packets, though this information may also be added by the encoding unit 205, for example, based upon the ultimate encoding that is performed.

In one or more embodiments, the EVS codec 26 includes several modes of operation for speech audio. Each mode of operation will have an associated encoded bit rate, for example. Depending on the bit rate of a particular mode, some are capable of multiple uses to transport a choice of audio bandwidths, or to transport speech encoded with the legacy AMR-WB codec, for example. Examples of these modes of operation for speech audio are demonstrated below in Table 1.

The LTE air interface has been designed with a fixed number of transport block sizes for use in transporting packets of a wide variety of sizes. The smaller of the transport block sizes are designed for the existing 3GPP codecs, e.g., for the third generation 3GPP wireless systems, and may be reused by the EVS codec 26 through judicious selection of bit rates modes the codec will operate in. In an embodiment, the EVS codec 26 encodes speech into 20 ms frames, and to minimize end-to-end delay, one frame may be transported per packet, though embodiments are not limited to the same.

Table 1 below illustrates these example speech EVS codec bit rates at the lower end of the bit rate range and the associated transport block sizes used in conjunction with the bit rate modes. The example size of the RTP payload is based upon the existing RTP payload size in the AMR-WB codec, noting that embodiments are not limited to this RTP payload size, or the limitations that such a payload is required to be an RTP payload.

TABLE 1

| EVS Codec Bit rate (kbps) | Bits per 20 ms Frame | RTP Payload | Unused bits (one frame per packet) | LTE Transport Block Size |
|---|---|---|---|---|
| 6.60 | 132 | 74 | 2 | 208 |
| 7.50 | 150 | 74 | 0 | 224 |
| 8.85 | 177 | 74 | 5 | 256 |
| 11.10 | 222 | 74 | 0 | 296 |
| 12.65 | 253 | 74 | 1 | 328 |
| 14.25 | 285 | 74 | 17 | 376 |

TABLE 1-continued

| EVS Codec Bit rate (kbps) | Bits per 20 ms Frame | RTP Payload | Unused bits (one frame per packet) | LTE Transport Block Size |
|---|---|---|---|---|
| 15.85 | 317 | 74 | 1 | 392 |
| 18.25 | 365 | 74 | 1 | 440 |
| 19.85 | 397 | 74 | 1 | 472 |
| 23.05 | 461 | 74 | 1 | 536 |
| 23.85 | 477 | 74 | 1 | 552 |

The above description is that of a fixed-rate codec, or a codec that encodes all active speech frames at a constant rate. For operation in packet-switched environments, the silence or pauses between speech utterances are encoded and transmitted at a very low rate and in a discontinuous fashion.

As discussed above, speech frames transported in networks are subject to erasure, and in particular in 3GPP cellular networks where there is an expectation of a small percentage of the transmitted data during transmission Frame erasure concealment (FEC) algorithms can be broadly classified into two categories: those that are codec independent and those that are codec dependent. Codec independent FEC algorithms are generic enough to be applied without the knowledge of the specific coding algorithms involved, and as a result are not as effective as codec dependent algorithms. Codec dependent algorithms are designed in conjunction with the codec during its development phase, and are typically more effective. One or more embodiments include at least codec dependent FEC algorithms, and codec dependent and independent FEC algorithms.

Frame erasure concealment algorithms herein can also be divided into another set of two broad categories: receiver based and sender based. Receiver based algorithms may be located solely in the speech decoder and/or the jitter buffer of the decoding unit 250 and are triggered by the frame erasure flags that the receiving side generates for the decoder. Error concealment of the decoding unit 250 may include data concealment approaches, including concealment based on the use of silence, white noise, waveform substitution, sample interpolation, pitch waveform replacement, time scale modification, regeneration based on knowledge or neighboring audio characteristics, and/or model based recover matching speech characteristics on either side of an error or loss to a model, as only example. Simple algorithms include the silence or noise substitution in the restored audio for erased frames, or repetition of a previous good frame, with the desire to minimize the user's observance of the packet loss. For a continuing string of frame erasures, the decoder would typically gradually mute the volume of the decoded speech. The more advanced algorithms could take into account the characteristics of a previously received good frame of speech and interpolate the previously received good parameters. If a jitter buffer is involved, there is an opportunity to use good frames of speech on both sides of the erased frame (assuming a single frame erasure) for interpolation purposes.

Sender-based FEC algorithms consume more resources but are more powerful than receiver-only techniques. Sender-based FEC algorithms usually involve sending redundant information to the receiver in a side channel for use in reconstructing a lost frame in the case of a frame erasure. The performance of sender-based algorithms is attributable to the ability to de-correlate the transmission of side information from that of the primary channel. In real-time speech coding applications in cellular networks, a partial de-correlation can be achieved by delaying the transmission of the redundant information by one or more frames. This will typically incur a delay to the transmission path of an already delay-constrained system, a delay that may be partially mitigated by the jitter buffer at the receiving end, e.g., the jitter buffer of the decoding unit 250.

According to one or more embodiments, the side or redundancy information that is provided to the receiver may include a complete copy of the original speech frame (full redundancy) or a critical subset of that frame (partial redundancy). Selective redundancy is a technique herein wherein a selected subset of speech frames is sent with side information. The full speech frame or a subset of the frame can be sent in a selective manner. Another approach herein is to encode speech with two separate codecs, one a desired codec for most coding and the other a low-rate low-fidelity codec, according to one or more embodiments. In example embodiment including multiple renderings, both versions of encoded speech are transmitted to the decoder, with the low-rate version considered the side channel.

In addition, one or more embodiments implement unequal error protection, where encoded bits of a frame are separated into classes, for example, A, B and C based upon the sensitivity of the respective bits or parameters to erasure. Erasure of class A bits or parameters may have a higher impact of voice quality than when class C bits or parameters are lost. The separating of the encoded bits or parameters of the frame into classes may also be referred to as dividing the frame into sub-frames, noting that the use of the term sub-frame does not require the separated encoded bits to all be contiguous for each sub-frame.

The receiver's task in a sender-based FEC system is to identify a frame erasure, and to determine if redundant side information for that erased frame has been received. If that side information is also lost, the situation is similar to that of a receiver-based FEC system and receiver-based FEC algorithms can be applied. If the redundant side information is present, it is used to conceal the lost frame along with any other relevant information that the receiver has available for concealment purposes.

As introduced above, the EVS codec 26 may include a High FER mode of operation, distinguished from other modes of operation. The High FER mode of operation of the EVS codec 26 may not be a primary mode of operation, but a mode that is chosen when it is known that the user is experiencing a higher than normal rate of frame loss. The terminals 200 and network 140 implement the LTE air interface with use of a hybrid automatic repeat request (HARQ) to transmit blocks of bits at the physical layer level. The success or failure of this mechanism can provide quick feedback as to whether a frame was successfully transmitted through the air interface. Feedback on link quality involving the entire transmission path may typically be slow and could involve either higher layer communication or dedicated in-band signaling between EVS codecs 26 in the case of a mobile-to-mobile call, in one or more embodiments.

One or more embodiments provide the FEC framework for the High FER mode of operation of the EVS codec 26. This framework is valid for fixed rate modes and bandwidths of the EVS codec 26. In an embodiment, this FEC framework is valid for all fixed rate modes and bandwidths of the EVS codec 26. According to one or more embodiments, the framework includes a method for partial and full redundancy transport of fixed-rate encoded frames. In an embodiment, both the partial and full redundancy transport fixed size transport blocks during the High FER mode. The transition from a normal mode of operation to the High FER mode may also include a change in transport block size. Embodiments equally include methods using partial, unequal, or full redundancy with fixed size transport blocks with fixed or variable bit rates, and partial, unequal, or full redundancy with variable size transport blocks with fixed or variable bit rates.

According to one or more embodiments, the High-FER mode of the EVS codec 26 of FIG. 1 is an example of selective redundancy.

As noted below, there are two example interaction points with the EVS codec 26 in an EPS environment, e.g., feedback from the decoding unit 150 to the encoding unit 100, so the encoding unit 100 makes the decision of whether to enter the High FER mode of operation, and the decoding unit 150 makes the decision of whether to enter the High FER mode of operation based on the decoding unit 150 monitoring the frame erasure rate, for example. If the decoding unit 150 makes the decision to enter the High FER mode of operation, that decision is transmitted to the encoding unit 100 so the next frames of audio or speech are encoded in the High FER mode of operation. Similarly, with the arrangement of FIG. 2B, if the terminal 200 is encoding audio or speech data and decoding audio or speech data, such as in a conference call or VOIP session, if one of the encoding unit 100 and decoding unit 150 decides that the High FER mode of operation should be entered based upon received information, the terminal 200 may encode next frames in the High FER mode of operation. The respective codings of the far end terminal 200 should also be performed in the High FER mode of operation, e.g., based upon the signaling associated with the frame.

Depending on embodiment, the EVS codec 26 enters the High FER mode of operation based upon information processed one or more of four sources: 1) fast feedback (FFB) information, as HARQ feedback transmitted at the physical layer; 2) slow feedback (SFB) information; feedback from network signaling transmitted at a layer higher than the physical layer; 3) in-band feedback (ISB) information: in-band signaling from the EVS codec 26 at a far end; and 4) high sensitivity frame (HSF) information: selection by the EVS codec 26 of specific critical frames to be sent in a redundant fashion. Sources (1) and (2) may be independent of the EVS codec 26, while (3) and (4) are dependent on the EVS codec 26 and would require EVS codec 26 specific algorithms.

The decision to enter the High FER mode of operation, HFM, is made by a High FER Mode Decision Algorithm. In one or more embodiments, the coding mode setting units 255 of FIG. 2B may implement the High FER Mode Decision Algorithm according to the below Algorithm 1, as only an example.

| Algorithm 1: | |
|---|---|
| Definitions | |
| SFBavg: | Average error rate over Ns frames |
| FFBavg: | Average error rate over Nf frames |
| ISBavg: | Average error rate over Ni frames |
| Ts: | Threshold for slow feedback error rate. |
| Tf: | Threshold for fast feedback error rate. |
| Ti: | Threshold for inband feedback error rate. |
| Set During Initialization | |
| Ns = | 100 |
| Nf = | 10 |
| Ni = | 100 |

-continued

| Algorithm 1: | |
|---|---|
| Ts = | 20 |
| Tf = | 2 |
| Ti = | 20 |

Algorithm

```
Loop over each frame {
HFM = 0;
IF((HiOK) AND SFBavg > Ts) THEN HFM = 1;
ELSE IF ((HiOK) AND FFBavg > Tf) THEN HFM = 1;
ELSE IF ((HiOK) AND ISBavg > Ti) THEN HFM = 1;
ELSE IF ((HiOK) AND (HSF = 1) THEN HFM = 1;
Update SFBavg;
Update FFBavg;
Update ISBavg;
}
```

As noted above, depending on embodiment, coding mode setting units 255 of FIG. 2B may instruct the EVS codec 26 to enter the High FER mode of operation based upon the analysis of information processed one or more of four sources, such as the SFBavg which is derived from a calculated average error rate of Ns frames using the SFB information, the FFBavg which is derived from a calculated average error rate of Nf frames average using the FFB information, the ISBavg which is derived from a calculated average error rate of Ni frames using the ISB information, and respective thresholds Ts, Tf, and Ti. Based upon comparisons to the respective thresholds, the coding mode setting units 255 of FIG. 2B may determine whether to enter the High FER mode and which FEC mode to select. The selected FEC mode may also be based upon determined coding type and frame classification determinations discussed below with regard to Tables 6 and 7, In one or more embodiments, subsequent to the decision to enter a High FER mode of operation, there are a number of sub-modes within the High FER mode of operation that are further chosen from for encoding the audio or speech information. Thereafter, the High-FER mode of operation operates in one or more of the number of sub-modes, and a small number of bits may be used for signaling which of the respective sub-modes has been chosen. These small number of bits may become part of the overhead, and potentially they may be reserved bits within a current or future fourth generation 3GPP wireless network, as only an example.

In an embodiment, only one bit in an RTP payload may be required to signal the High FER mode of operation; this one bit can be considered a High FER mode flag. As an example, the RTP payload in the existing AMR-WB has four extra bits (in the octet mode), i.e., bits that are reserved or not assigned. Additionally, once in the High FER mode of operation only a few bits may need to be reserved to signal the sub-modes; these bits can be considered an FEC mode flag. These bits can be protected with redundancy similar to the below redundancy for the class A bits of Table 3, for example.

Sender-based FEC algorithms typically use a side channel to transport redundant information. In one or more embodiments, in the context of the EVS codec 26 and its use in EPS, one or more embodiments make efficient use of the transport blocks defined for the LTE air interface, even though the expected EVS codec does not provide for such side channels. For each mode of operation, the below Table 2 shows a number of additional bits available by selecting the next higher or second next higher transport block size (TBS). In an embodiment, for efficient operation, all of the additional bits may be used.

TABLE 2

| Bit rate (kbps) | Bits per Frame | RTP Payload | unused | Transport Block Size | # FEC bits if Using next TBS | # FEC bits if using $2^{nd}$ larger TBS |
|---|---|---|---|---|---|---|
| 6.60 | 132 | 74 | 2 | 208 | 16 | 48 |
| 7.50 | 150 | 74 | 0 | 224 | 32 | 72 |
| 8.85 | 177 | 74 | 5 | 256 | 40 | 72 |
| 11.10 | 222 | 74 | 0 | 296 | 32 | 80 |
| 12.65 | 253 | 74 | 1 | 328 | 48 | 64 |
| 14.25 | 285 | 74 | 17 | 376 | 16 | 64 |
| 15.85 | 317 | 74 | 1 | 392 | 48 | 80 |
| 18.25 | 365 | 74 | 1 | 440 | 32 | 96 |
| 19.85 | 397 | 74 | 1 | 472 | 64 | 80 |
| 23.05 | 461 | 74 | 1 | 536 | 16 | |
| 23.85 | 477 | 74 | 1 | 552 | | |

Robustness to frame loss is achieved by sending redundant bits or parameters associated with frame n in a packet not associated with frame n. For example, frame n encoded bits are sent in packet N, while redundancy bits associated with frame n are sent in packet N+1. This is known as time diversity. If packet N is erased and packet N+1 survives, the redundancy bits can be used to conceal or reconstruct frame n.

Figure 3:
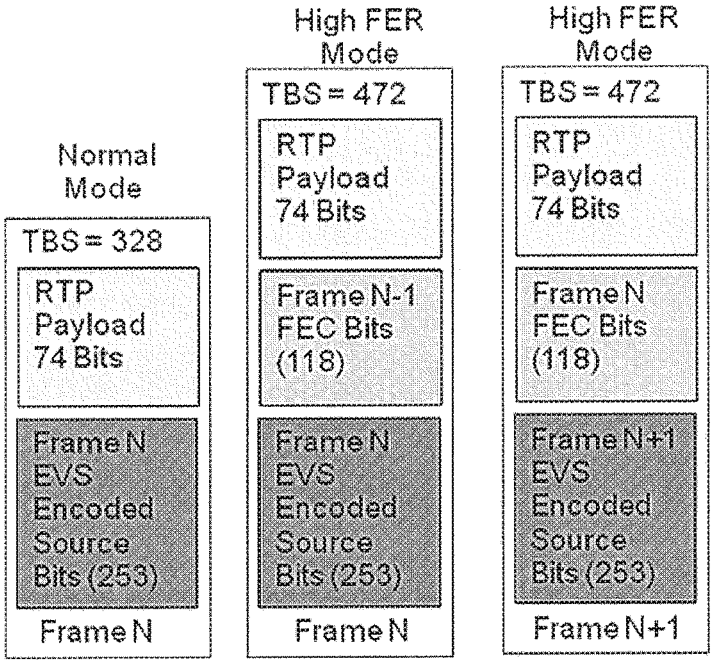
FIG. 3 illustrates an example of redundant bits for one frame being provided in an alternate packet, according to one or more embodiments.

FIG. 3 illustrates an example of redundant bits for one frame being provided in an alternate packet, according to one or more embodiments.

In FIG. 3, the first (left) packet represents a normal mode of operation, i.e., a non-High FER mode of operation of the EVS codec 26. The packet includes a frame of speech encoded according to the 12.65 kbps mode of operation of the EVS codec 26. In addition, there is an RTP payload header of size 74 bits, the same size as the AMR-WB codec RTP payload. The middle packet represents the transport mechanism in the High-FER mode of operation, wherein 118 FEC bits are included in the packet for the previous frame n−1. The middle packet with the redundant information is now the size of the 472 bit transport block. The third packet represents the next in the sequence of packets in the High FER mode of operation, with the third packet representing the transport mechanism in the High FER mode of operation, again, where 118 FEC bits are included in the packet for the previous frame n. Accordingly, in one more embodiments, within the High FER mode of operation data at least one alternate packet is used to send redundancy information.

Figure 4:
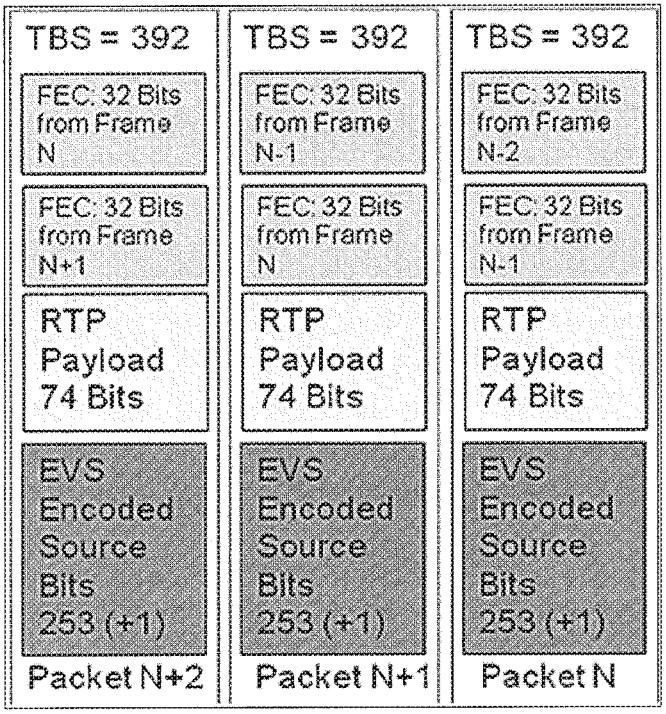
FIG. 4 illustrates an example of redundant bits for a frame being provided in two alternate packets, according to one or more embodiments.

FIG. 4 illustrates an example of redundancy bits for frame n being provided in two alternate packets, according to one or more embodiments.

As illustrated in FIG. 4, each packet may include the EVS encoded source bits for a respective frame, and FEC bits for two different previous frames. For example, packet N+2 includes the EVS encoded source bits, FEC bits for frame n+1, and FEC bits for frame n. Said another way, in one or more embodiments, redundancy bits for frame n are transported in the two next packets N+1 and N+2.

Figure 5:
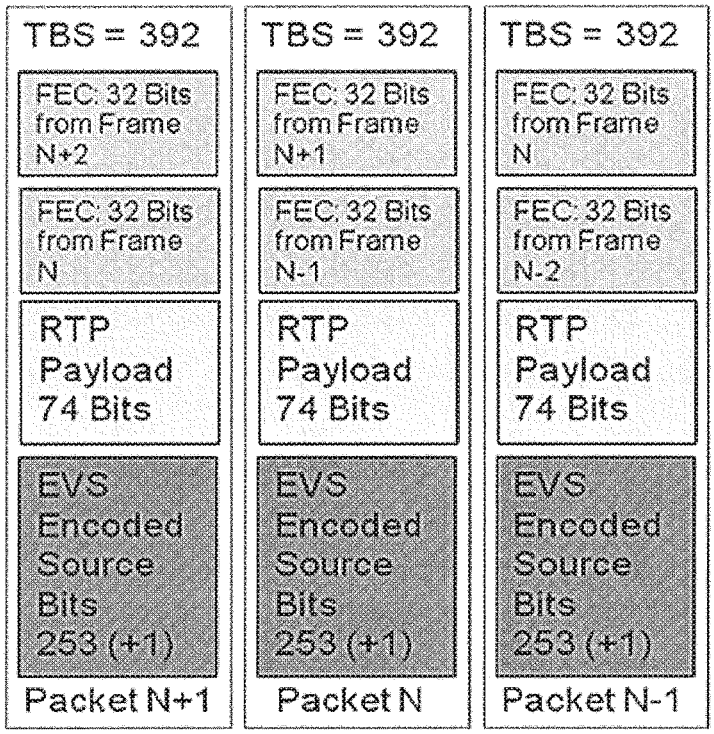
FIG. 5 illustrates an example of redundant bits for a frame being provided in alternate packets before and after the packet of the frame, according to one or more embodiments.

FIG. 5 illustrates an example of redundancy bits for frame n being provided in alternate packets before and after the packet of frame n, according to one or more embodiments.

In the FIG. 5, an extra frame of delay is inserted by the encoder to place the redundancy bits in packets before and after the packet containing the EVS encoded source bits for the target frame. The approach of FIG. 5 shifts additional delay from the decoder to the encoder. In addition, the approach of FIG. 5 shifts the erasure pattern such that a triple erasure results in redundancy bits for the middle erasure in the sequence surviving rather than the redundancy bits for the oldest erasure in the sequence. The alternate packets may be considered neighboring packets, noting that additional packets including non-consecutive packets before or after the middle packet, and additional packets including non consecutive packets before or after the middle packet, may also be referred to as neighboring packets.

In addition to the placement of the redundancy bits in one or more different neighboring packets, redundancy bits may be selectively included with more or less redundancy based upon their perceptual importance.

Accordingly, in one or more embodiments, a High FER mode of operation for fixed bit rates uses an unequal redundancy protection concept wherein encoded speech bits are prioritized and protected with more, equal, or less redundancy according to their perceptual importance. In an example using 3GPP codecs AMR and AMR-WB, encoded bits are classified into classes, for example class A, B and C where class A bits are the most sensitive to erasure and class C bits are the least sensitive to erasure, according to one or more embodiments. Different mechanisms exist for providing protection of these bits, depending on whether the application uses circuit-switched or packet-switched transport.

According to one or more embodiments, the provision of unequal redundancy protection may be extended to both source encoded bits as well as additional FEC side information. The different classes of bits are transported in a redundant manner using time diversity, with the amount of redundancy depending upon the class of bits.

Figure 6:
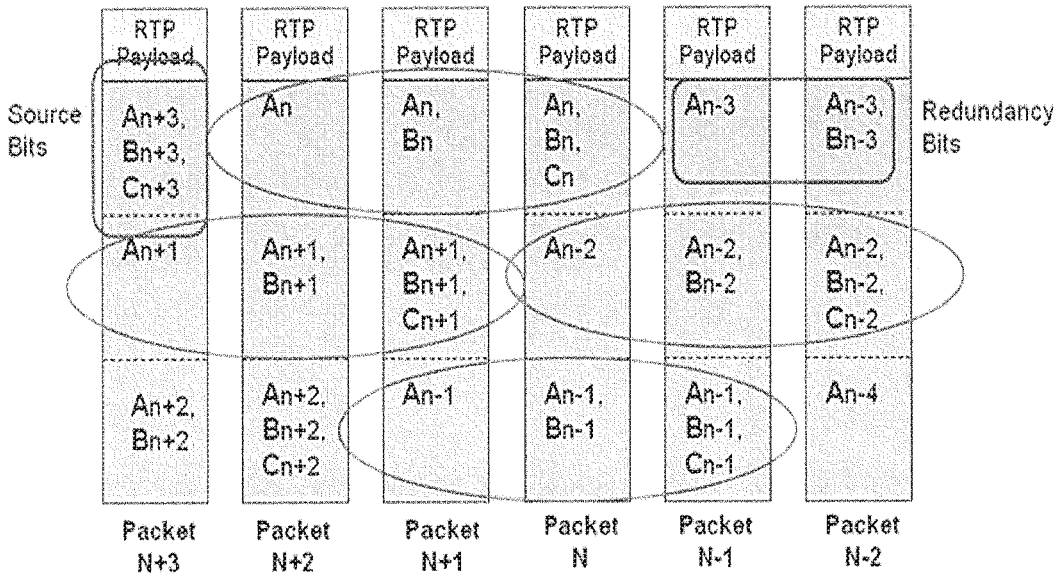
FIG. 6 illustrates unequal redundancy of source bits in alternative packets respectively based upon the different classification of source bits, according to one or more embodiments.

FIG. 6 illustrates unequal redundancy of source bits in alternative packets respectively based upon the different classification of source bits, according to one or more embodiments. FIG. 6 is another way of representing what is illustrated in FIGS. 3-5.

As illustrated in the embodiment of FIG. 6, three categories of bits have been defined. The source bits that are categorized as class A bits are redundantly transported three times in three consecutive packets. The source bits that are categorized as class B bits are redundantly transported two times in two consecutive packets. The source bits that are categorized as class C bits are redundantly transported only one time. In the figure, "N" represents the packet number and "n" represents the frame number. In the example of FIG. 6, each packet is of the same size and contains 3*A+2*B+C bits in addition to the RTP payload.

With sufficient jitter buffer depth of the decoder, e.g., the decoding unit 250, the decoder has three opportunities to decode the class A bits or parameters, two opportunities to decode the class B bits or parameters and one opportunity to decode the class C bits or parameters. As a result, it takes three consecutive packet erasures to lose the class A bits or parameters and two consecutive packet erasures to lose the class B bits or parameters. As only an example, alternative embodiments may at least include an approach that divides the encoded source bits into more or fewer classes, for example (A, B) or (A, B, C, D), an approach that achieves full redundancy rather than partial redundancy by also redundantly transporting the class C bits, an approach directed toward a desired very high efficiency operation, the class C bits are not transmitted, and an approach where only the class A bits are redundantly transmitted for efficiency purposes.

Accordingly, in one or more embodiments, in addition to including FEC bits for a current frame in previous or subsequent neighboring frames, the bits of a source frame may be categorized based upon priority, such as according to their perceptual importance. Bits or parameters of the source frame that have the greatest perceptual importance, or which would be more noticeable to the human ear if lost, would be redundantly transmitted in more neighboring packets than bits or parameters of the same source frame that are differently categorized to have a lesser perceptual importance.

Side information from the encoder can be part of the encoding algorithm. This side information can also be redundantly transmitted as the other bits or parameters, as discussed in greater detail below.

For concealment purposes, a decoder can benefit not only from redundant copies of the encoded source bits, such as in FIG. 3-6, but also from frame erasure concealment (FEC) parameters specifically designed for decoder FEC algorithms, according to one or more embodiments. As only an example, in the ITU-T speech codec standard G.718, 16 FEC bits are sent as side information in layer 3 of the codec (when layer 3 is available) and used for layer 1 concealment purposes.

As only an example, we use the 6.6 Kbps mode of the EVS codec 26 and the side information from the G.718 codec in the below Table 3 example. The 6.6K mode of the EVS codec 26 contains 132 source bits. In addition we define 2 additional bits for FEC signaling and 16 more bits for FEC side information, similar to G.718. The table below shows an example allocation of the EVS source and FEC bits according to priorities, according to one or more embodiments.

TABLE 3

| Priority | EVS Codec 6.6K Mode Source Bits | FEC Bits |
|---|---|---|
| A | 41<br>coder_type (3)<br>ISF's (31)<br>midISFs (4)<br>Energy (3) | 4<br>(G.718) frame class (2)<br>FEC sub-mode (2) |
| B | 43<br>$1^{st}$ subframe pitch(8)<br>all subframe gains (4*5)<br>$2^{nd}$-$4^{th}$ subframes pitch(3*5) | 14<br>(G.718) Pulse position (8)<br>(G.718) Energy (6) |
| C | 48<br>cb_bits (4*12) | — |
| Total | 132 | 18 |

In the example of Table 3 above, there are a total of 45+57+48 bits to be transported. Using the redundancy method outlined above, each packet will contain a total of 3A+2B+C bits, =297 bits+74 RTP payload bits for a total of 371 bits. This fits in the example transport block of size 376 with 5 bits left over. Here, differently classified A, B, and C bits may represent differently classified parameters of the speech, such as linear prediction parameters for when the codec operates as a code-excited linear prediction (CELP) codec based on the mode of operation.

Accordingly, once the High FER mode of operation has been entered, according to one or more embodiments, there are several sub-modes available depending on the amount of bandwidth available (capacity) and FEC protection (robustness) desired, as only examples. These parameters can be traded off with the amount of intrinsic speech quality required, for example. In one or more embodiments and only as an example, there are six sub-modes, each addressing differing priorities of bandwidth (capacity), quality, and error robustness. The attribute of the various sub-modes are listed in the below Table 4.

In the examples below, we assume only redundancy transport of source bits (represented by class A, B and C) and that there are no dedicated FEC bits. As only a convenience, an RTP payload size of 74 is assumed in all examples.

TABLE 4

| Sub-mode | Bit Rate | TBS | Numerology | Features |
|---|---|---|---|---|
| Normal Mode | Depends on Codec Mode (12.65 Kbps in example) | Depends on Codec Mode (328 in example) | | Original codec mode. One of N may be selected. |
| 1 | 7.5 Kbps | 224 | A, B, C = 14, 62, 56. 2A + B + C = 150. 150 + 74 = 224. | Shift to 6.6K mode. Single redundancy of class A bits only. Mild robustness and lower capacity impact. |
| 2 | 8.85 Kbps | 256 | A, B, C = 14, 62, 56. 3A + 2B = 166. 166 + 74 = 256. | Shift to 6.6K mode. Dual redundancy of class A bits. Single redundancy of class B bits. Drop the class C bits. Lower capacity desired and high redundancy of more critical bits. |
| 3 | 11.1 Kbps | 296 | A, B, C = 14, 62, 56. 3A + 2B + C = 222. 222 + 74 = 296. | Shift to 6.6K mode. Dual redundancy of class A bits. Single redundancy of class B bits. No redundancy in class C bits. Higher redundancy and lower capacity than original. |
| 4 | Depends on Codec Mode (12.65 Kbps in example) | Depends on Codec Mode (TBS = 328 in example) | A, B, C = 46, 30, 56. 3A + 2B + C = 254. 254 + 74 = 328. | Shift to 6.6K mode. Maintains original packet size. No capacity impact. Lower quality and higher robustness. |
| 5 | 14.25 Kbps | 376 | A, B, C = 38, 38, 56. 3A + 2B + 2C = 302. 302 + 74 = 376. | Shift to 6.6K mode. Full redundancy of all source bits. Dual redundancy of class A bits. |
| 6 | Depends on Codec Mode (18.25 Kbps in example) | Depends on Codec Mode (TBS = 440 in example) | A, B, C = 20, 73, 160 3A + 2B + C = 366 366 + 74 = 440 | Maintain original codec mode. Add redundancy into a larger packet. Packet size depends on the original mode. Maintain high quality, higher robustness at cost of capacity. |

Figure 7:
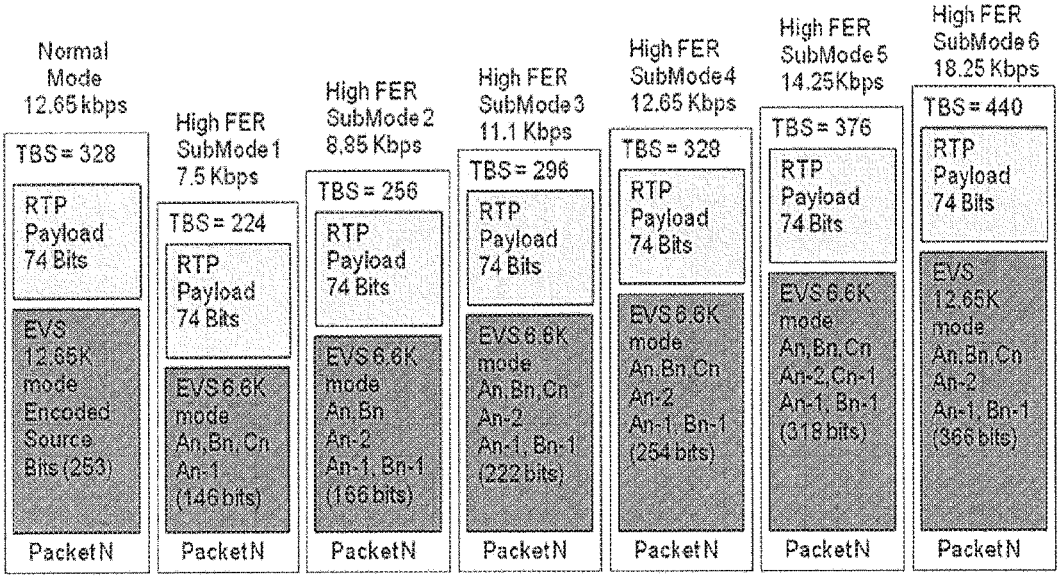
FIG. 7 illustrates example FEC modes of operation, with unequal redundancy, according to one or more embodiments.

FIG. 7 illustrates example FEC modes of operation, with unequal redundancy, according to one or more embodiments. Many of the sub-modes use the same EVS coding mode, for example, as implemented in the non-High FER mode speech modes. In this example, the lowest mode was selected for efficiency purposes, as robustness and capacity are normally the highest priorities when in the High FER mode of operation. In addition, use of the same EVS coding mode simplifies the FEC algorithms as the decoder has to deal with FEC of only one coding mode. Alternatively, as discussed below, alternative embodiments include use of additional coding modes.

As illustrated in FIG. 7, as the sub-modes progress from sub-mode 1 to sub-mode 6 there is an increased need or desire for larger packet sizes to accommodate the ever increased redundancies.

Figure 11:
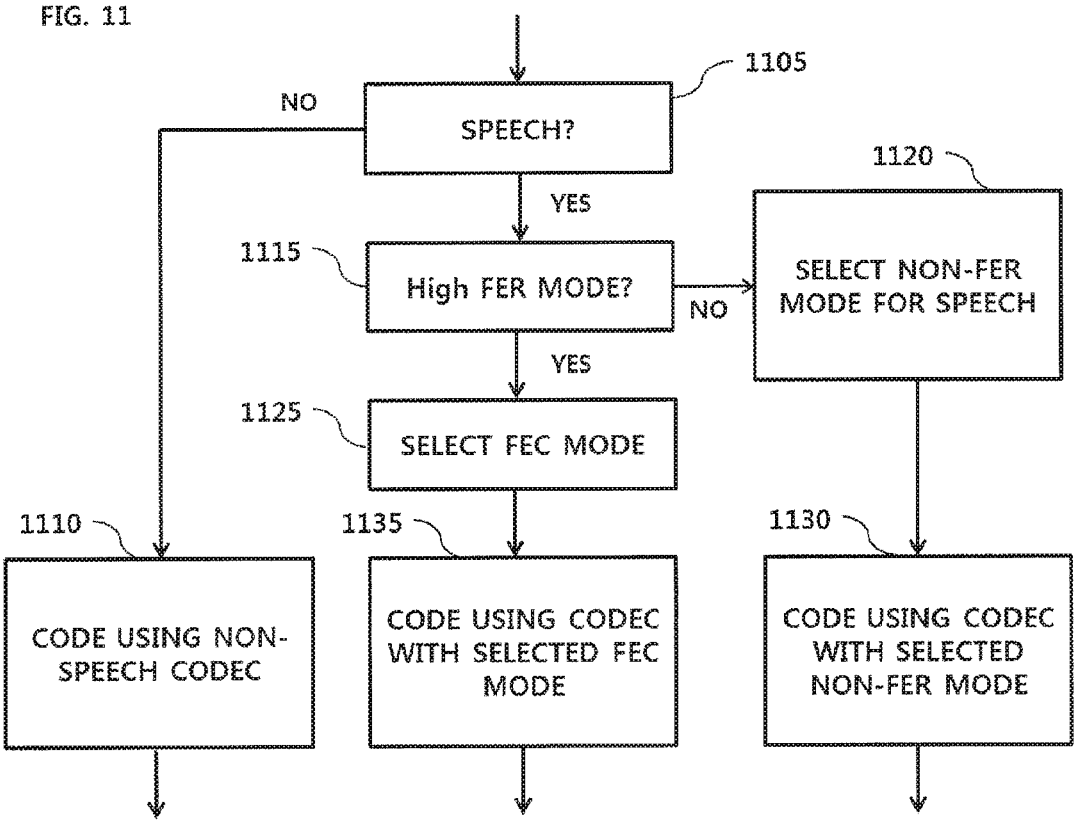
FIG. 11 sets forth a method coding audio data using different FEC modes of operation in a High FER mode, according to one or more embodiments.

FIG. 11 sets forth a method coding audio data using different FEC modes of operation in a High FER mode, according to one or more embodiments.

As illustrated in FIG. 11, input audio may be analyzed and there is a determination as to whether the input audio is speech audio or non-speech audio, in operation 1105. If the input audio is not speech audio, then the input audio may be encoded by a non-speech codec. If the input audio is determined to be speech audio, then there is a determination as to whether to enter the High FER mode, in operation 1115. The relevant discussion above regarding Equation 1 provides an example of considerations made for this determination of whether to enter the High FER mode. If the determination in operation 1115 indicates that the High FER mode should not be entered, then the mode of operation for speech encoding is selected for the EVS codec 26, e.g., one of the modes of operation discussed above in Table 1, in operation 1120. Once the mode of operation for the speech encoding is selected in operation 1120, the input audio is encoded according to the selected mode of operation for speech encoding, in operation 1130. If operation 1115 does result in the High FER mode being entered, then there is a selection among the available one or more FEC modes of operation, in operation 1125. Thereafter, in operation 1135, the input audio is encoded using the EVS codec 26 in the selected FEC mode of operation.

Figure 14:
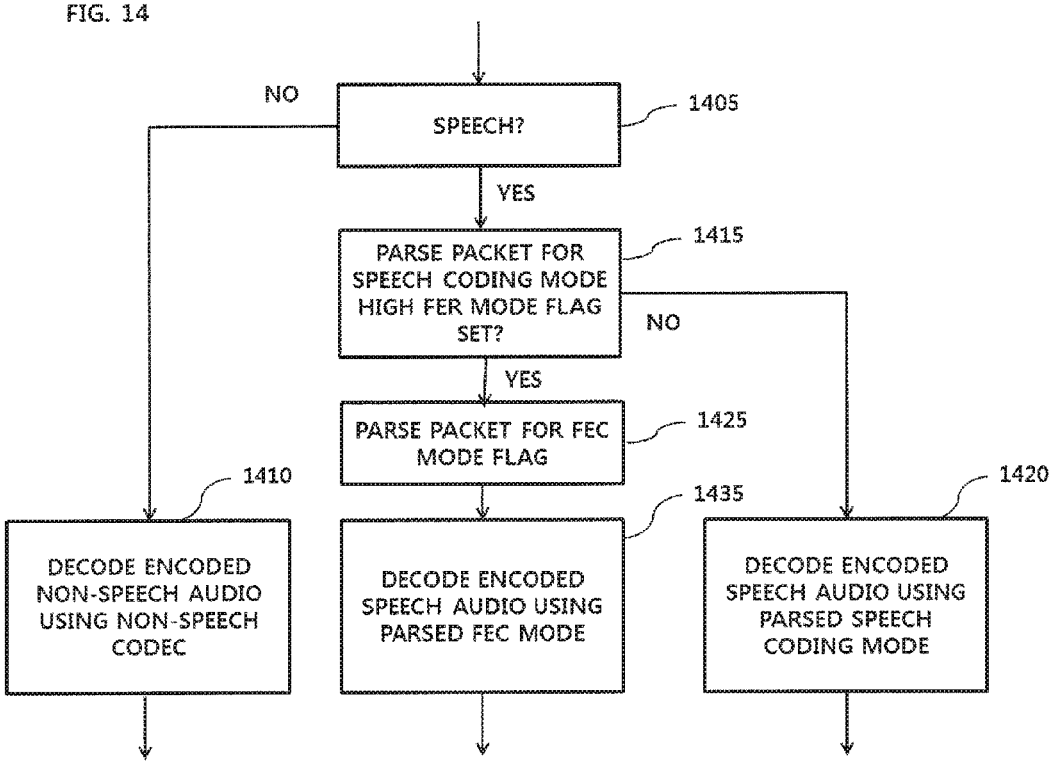
FIG. 14 illustrates a method of decoding audio data using different FEC modes of operation in a High FER mode, according to one or more embodiments.

Similarly, FIG. 14 illustrates a method of decoding audio data using different FEC modes of operation in a High FER mode, according to one or more embodiments. In operation 1405 there may be a determination of whether an encoded frame in a received packet was encoded based upon the audio being speech or non-speech audio. If the speech is non-speech audio, then in operation 1410 the appropriate mode of operation for decoding the non-speech audio would be performed by the EVS codec 26, for example. If the received packet includes encoded speech data, then the packet is parsed to determine the mode of operation for the speech decoding, including determining whether the frame was encoded in the High FER mode, in operation 1415. If the frame was not encoded in the High FER mode, e.g., if the High FER mode flag is not set in the received packet, then the appropriate mode of speech decoding will be selected and the EVS codec 26 will decode the according to the appropriate mode of speech decoding, in operation 1420. If the frame is determined to have been encoded in the High FER mode, in operation 1415, then the packet may be parsed to determine what FEC mode of operation was used to encode the frame, in operation 1425. Based on the determined FEC mode of operation, the EVS codec 26 may then decode the frame based upon the determined FEC mode of operation. Here, in one or more embodiments, the method of FIG. 14 further includes a determination before or during operations 1405 and 1415, as only examples, as to whether the packet has been lost. This determination may include an instruction to the EVS codec 26 to use redundant information in the next or previous packets, based on the FEC framework according to one or more embodiments, to reconstruct the lost packet or to conceal the lost packet based on redundant information in the neighboring packets.

As an alternative to the transport block sizes being different in FIG. 7, the same transport block size may be maintained for plural modes, such as used in the regular mode of operation. This has the benefit of not requiring the EPS system to signal packet size changes, but comes at a disadvantage of using several of the EVS codec 26 modes in the High FER mode. This disadvantage stems from the fact that the concealment algorithms get more complex with more codec modes to deal with.

Figure 8:
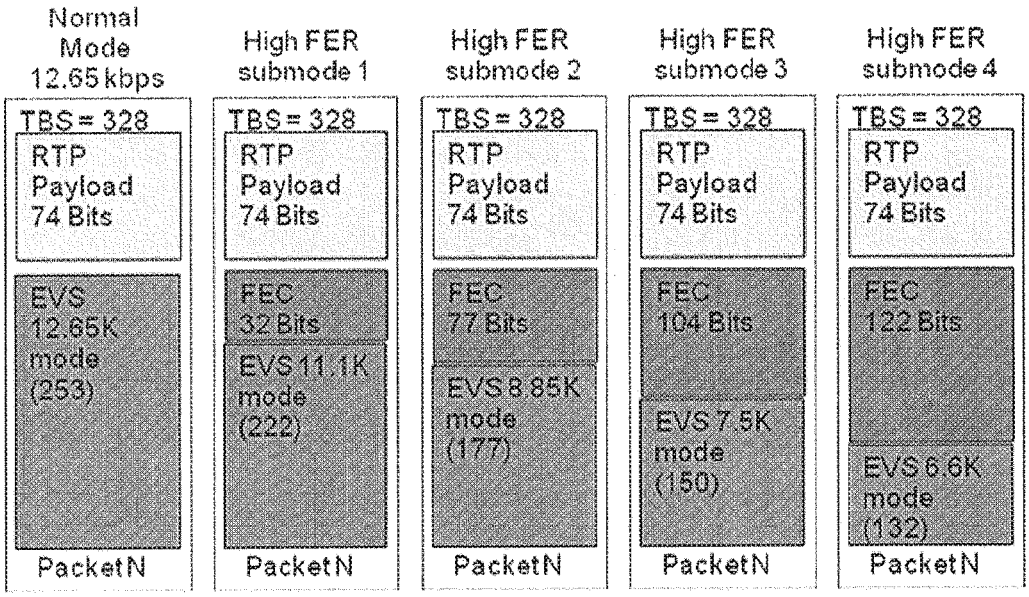
FIG. 8 illustrates different FEC modes of operation for the High FER mode of operation with a same transport block size, according to one or more embodiments.

FIG. 8 illustrates different FEC modes operation for the High FER mode with a same transport block size, according to one or more embodiments. Herein, the different FEC modes of operation may be considered sub-modes of the High FER mode. In this example, the EVS codec 26 12.65 Kbs mode of operation is used as an example of the normal non-High FER mode of operation. Each of the High FER sub-modes 1-4 maintain the same transport block size of 328. Increases in redundancy are accompanied by a lower source coding rate.

Contrary to previous methods used by other 3GPP codecs in circuit-switched transport, e.g., where the multimode AMR and AMR-WB codecs can have their mode switched to lower or raise the bit rate based on channel conditions, FIG. 8 demonstrates that the bit rates are lowered in the different sub-modes so additional redundancy or FEC bits can be included and the frame packet sized maintained.

Figure 12:
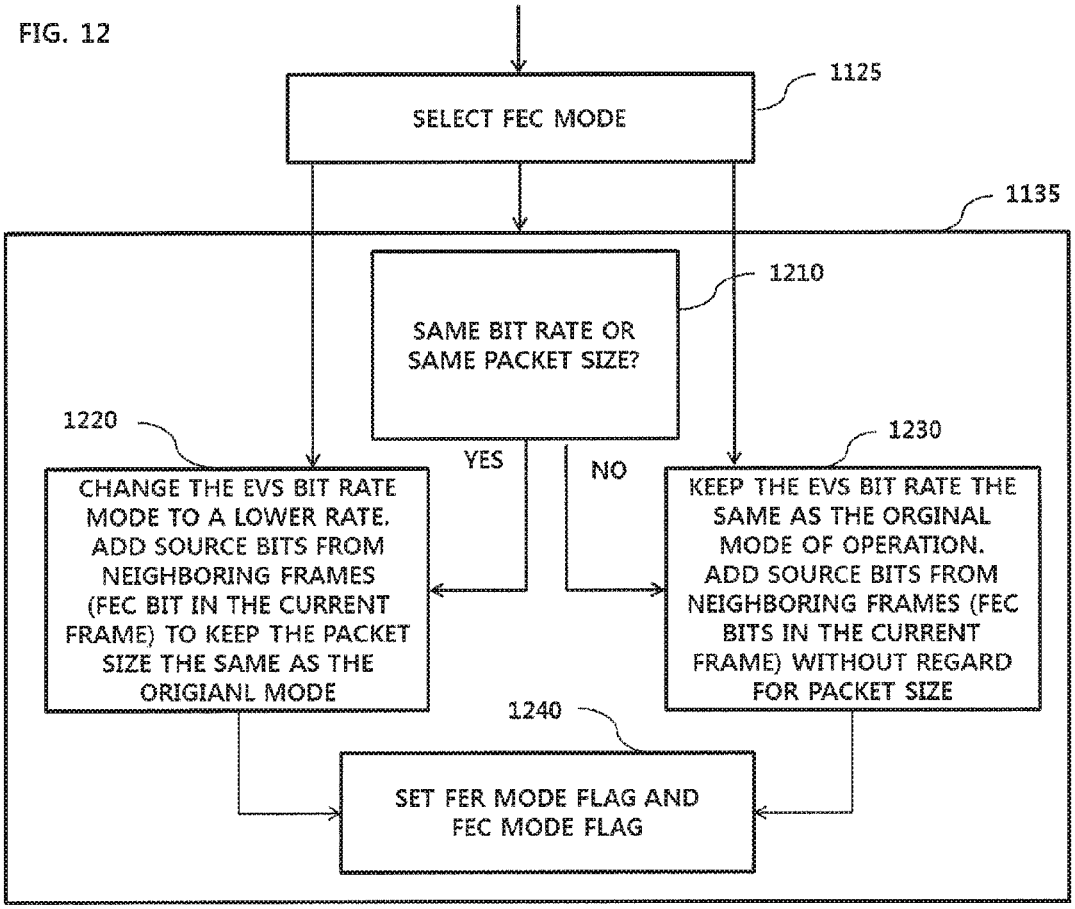
FIG. 12 illustrates an FEC framework based upon whether the same bit rate or packet sizes are maintained for all FEC modes of operation, according to one or more embodiments.

FIG. 12 illustrates an FEC framework based upon whether the same bit rate or packet sizes are maintained for all FEC modes of operation, according to one or more embodiments.

As illustrated in FIG. 12, in operation 1125 there is a selection of the FEC mode of operation, and in operation 1135 the selected FEC mode of operation is implemented by the EVS codec 26. As illustrated, operation 1125 may directly select either of the FEC modes of operation represented by operation 1220 or operation 1230, or there may be a further determination in operation 1210 as to whether the same bit rate or same packet size is desired. If the operation 1210 indicates that the same bit rate or packet size is determined, then operation 1220 may be performed, and otherwise operation 1230 is performed. Operation 1230 may be considered similar to FIG. 7, where packet sizes are allowed to vary. Alternatively, in operation 1220, the encoded EVS source bits from neighboring frames are added to a reduced-rate mode of encoded EVS source bits of the current packet. In operation 1240, as the High FER mode was entered and FEC mode of operation selected, this information may be reflected in flags in the packet of the encoded frame. The High FER mode may be set using a single bit within the packet, and the selected FER mode of operation could be set using only 2-3 bits, as only an example.

According to one or more embodiments, another approach that maintains the same transport block size after entering the High FER mode of operation involves a procedure termed codebook 'robbing', and may be useful when it is desired to provide a small amount of redundancy similar to sub-mode 1 in Table 4 and FIG. 8. The EVS codec 26 frames are divided into sub-frames, and for each sub-frame, a number of codebook bits are computed as parameters. The number of codebook bits differs by encoding mode as shown in the below Table 5.

TABLE 5

| total bits | 132 6k60 | 150 7k50 | 177 8k85 | 222 11k10 | 253 12k65 | 285 14k25 | 317 15k85 | 365 18k25 | 397 19k85 | 461 23k05 | 477 23k85 |
|---|---|---|---|---|---|---|---|---|---|---|---|
| speech/audio core | 0 | 1 | 1 | 1 | 1 | 1 | 1 | 1 | 1 | 1 | 1 |
| coder_type | 3 | 3 | 3 | 3 | 3 | 3 | 3 | 3 | 3 | 3 | 3 |
| ISFs | 31 | 31 | 31 | 38 | 37 | 37 | 43 | 43 | 43 | 43 | 43 |
| midISFs | 4 | 4 | 3 | 4 | 4 | 4 | 5 | 5 | 5 | 5 | 5 |
| scal. energy pred. | 3 | 3 | 3 | 4 | 4 | 4 | 5 | 5 | 5 | 5 | 5 |
| LTP filtering | 0 | 0 | 0 | 4 | 4 | 4 | 4 | 4 | 4 | 4 | 4 |
| 1st subfr pitch | 8 | 8 | 9 | 9 | 9 | 9 | 9 | 9 | 9 | 9 | 9 |
| 1st subfr gain | 5 | 6 | 6 | 6 | 6 | 6 | 6 | 6 | 6 | 6 | 6 |
| 2nd subfr pitch | 5 | 4 | 5 | 5 | 5 | 5 | 5 | 5 | 5 | 5 | 5 |
| 2nd subfr gain | 5 | 6 | 6 | 6 | 6 | 6 | 6 | 6 | 6 | 6 | 6 |
| 3rd subfr pitch | 5 | 4 | 5 | 5 | 5 | 5 | 5 | 5 | 5 | 5 | 5 |
| 3rd subfr gain | 5 | 6 | 6 | 6 | 6 | 6 | 6 | 6 | 6 | 6 | 6 |
| 4th subfr pitch | 5 | 4 | 5 | 5 | 5 | 5 | 5 | 5 | 5 | 5 | 5 |
| 4th subfr gain | 5 | 6 | 6 | 6 | 6 | 6 | 6 | 6 | 6 | 6 | 6 |
| cb_bits 1st subfr | 12 | 12 | 20 | 28 | 36 | 44 | 52 | 64 | 72 | 88 | 88 |
| cb_bits 2nd subfr | 12 | 12 | ~~20~~ 20 | 28 | ~~36~~ 36 | 44 | 52 | 64 | 72 | 88 | 88 |
| cb_bits 3rd | 12 | 20 | | 28 | | 44 | 52 | 64 | 72 | 88 | 88 |

TABLE 5-continued

| total bits | 132 6k60 | 150 7k50 | 177 8k85 | 222 11k10 | 253 12k65 | 285 14k25 | 317 15k85 | 365 18k25 | 397 19k85 | 461 23k05 | 477 23k85 |
|---|---|---|---|---|---|---|---|---|---|---|---|
| subfr cb_bits 4th | 12 | 20 | 28 | 36 | 44 | 52 | 52 | 64 | 72 | 88 | 88 |
| subfr HB energy | 0 | 0 | 0 | 0 | 0 | 0 | 0 | 0 | 0 | 0 | 16 |

In this embodiment, as only an example, if the EVS codec 26 regular mode of operation is 12.65 Kbps, that mode is maintained as the High FER mode of operation is entered. When in the High FER mode of operation, the encoder, for one of the four sub-frames, computes the codebook bits as if the mode of operation was 8.85 Kbps, even though the mode of operation is actually 12.65 Kbps. The sub-frames may be represented by bits of the frame or parameters representing the audio of the frame, such as with linear prediction parameters of a code-excited linear prediction (CELP) coding produced by the codec, when the codec acts as a CELP codec. As indicated in the above Table 5, 20 bits can be used to define the codewords for the bits of the $1^{st}$-$3^{rd}$ sub-frames instead of the 36 bits that would have been required if the codebook bits were calculated according to the 12.65 Kbps mode of operation. The 16 bits that are saved by this codebook 'robbing' approach are then used for FEC purposes. Transport of the FEC bits can be performed in the same packet size as in the original mode since there is the same number of bits. As in most of the High FER sub-modes, there is some quality degradation associated with this approach.

Accordingly, different from the approaches of Table 4 and FIG. 8, where the bit rate is sequentially reduced for the codec source coding in each sub-mode of the High FER mode of operation, Table 5 demonstrates that it is not necessary to reduce the bit rate, but rather only calculate the codewords as if the bit rate were the reduced bit rate. The FEC information illustrated in FIG. 8 can include redundancy similar to any of the above referenced FIGS. 1-6, including the unequal redundancy described above in Table 3. Here, as only an example, the divided sub-frames may be respectively used for the each of A, B, C, etc., of Table 3, with determined more important sub-frames or parameters having increased redundancy over other sub-frames or parameters.

Figure 13:
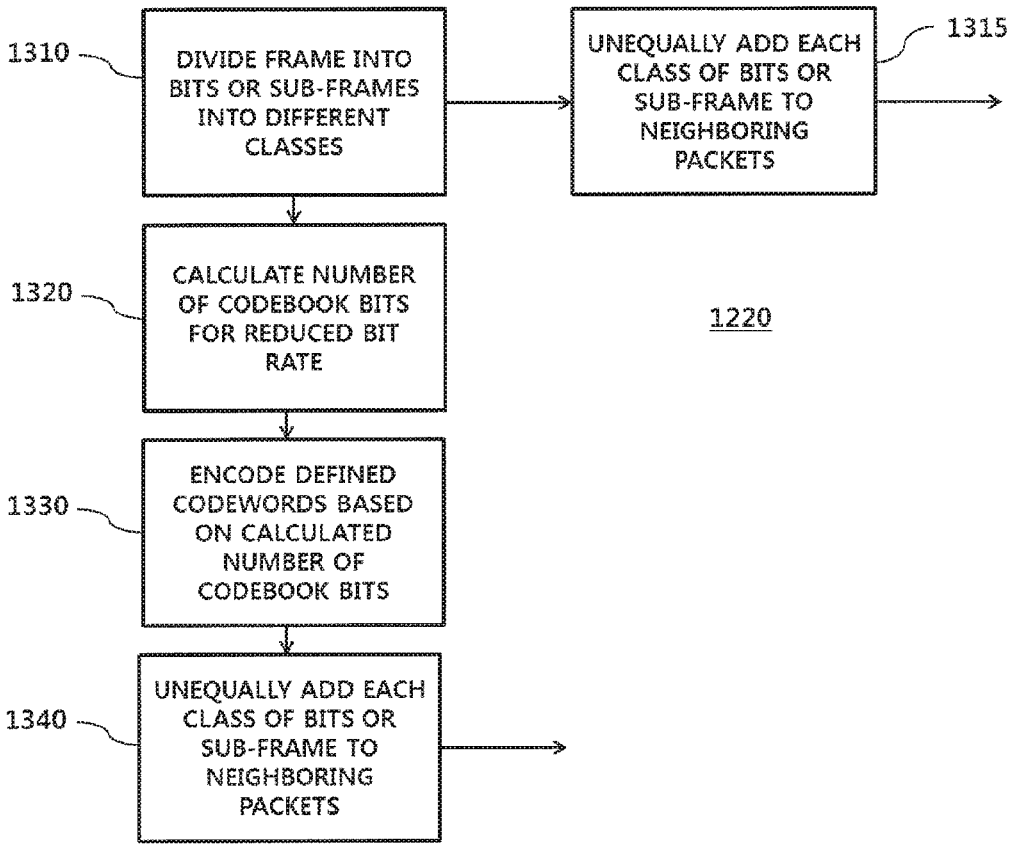
FIG. 13 illustrates three example FEC modes of operation, according to one or more embodiments.

FIG. 13 illustrates three example FEC modes of operation, according to one or more embodiments. As discussed above regarding Table 3 and FIG. 6, the bits or parameters of a frame may be separated into classes, e.g., based on their perceptual importance. Accordingly, in operation 1310, the frame may be divided or separated so that bits are classified into different classes or sub-frames, and in operation 1315, redundant information for each class or sub-frame may be unequally provided in the neighboring frame, such as in FIGS. 6 and 7.

Alternatively, in operation 1320, the number of codebook bits are calculated for each of the divided or separated bits or parameters, e.g., as classified into the separate classes or divided into separate sub-frames, for a bit rate less than the bit rate of the corresponding mode of operation the frame is being encoded in. Thereafter, in operation 1330, defined codewords based on the calculated number of codebook bits may be encoded.

Still further, in operation 1340, in consideration of the defined codewords, redundant information of the encoded separate classes or sub-frames may be unequally provided in the neighboring packets, similar to FIGS. 6 and 7.

The aforementioned approaches for the High FER mode of operation of FIGS. 3-8 and Tables 3-5, are designed for taking advantage of the fact that a speech frame can be divided into classes of bits or into classes of parameters, with the distinction between the classes the perceptual importance of the bit or parameter when subjected to erasure.

However, in some speech codecs, including the G.718 codec and an expected EVS candidate codec, input speech frames may be encoded with a variety of coding types, depending upon the type of speech. In both the G.718 codec and the EVS candidate codec, the encoded speech frames are further classified for FEC purposes. The classification of these frames is based upon the coding type and position of the speech frame in a sequence of speech frames.

As an example, Table 6 below shows, for wideband speech, the four coding types used in both the G.718 and EVS candidate codecs.

TABLE 6

| Coding Type | Code | Comment |
|---|---|---|
| Unvoiced WB | 0 | For unvoiced speech frames |
| Voiced WB | 2 | For purely voiced speech frames |
| Generic WB | 4 | Non-stationary speech frames |
| Transition WB | 6 | Used for enhanced frame erasure performance by limiting use of past information |

According to the G.718 codec, the coding type information is transmitted in a side channel. However, this side channel is currently not available in the expected EVS codec candidate. To overcome this lack of a side channel, side information similar to the approach of the G.718 codec can be transmitted as FEC bits using the concepts presented above and as shown in Table 3, as only an example. Given a dependence of one frame classification type on an adjacent frame classification type, the five coding types can be signaled with only two bits. According to one or more embodiments, such coding types are shown in the below table 7, as only an example.

TABLE 7

| Frame Classification | Code | Comment |
|---|---|---|
| Unvoiced | 0 | Unvoiced, silence, noise, voiced offset |
| Unvoiced Transition | 1 | Transition from unvoiced to voiced components - possible onset, but too small |
| Voiced Transition | 2 | Transition from voiced - still voiced, but with very weak voiced characteristics |
| Voiced | 3 | Voiced frame, previous frame was also voiced or ONSET |
| Onset | 4 | Voiced onset sufficiently well built to follow with a voiced concealments |

As noted above, variations of the packet structure shown in FIG. 6 are used to transport speech frames with varying amounts of redundancy, depending upon their perceptual importance. The perceptual importance of a frame can be determined from either the coding type as shown in Table 6, the frame classification as shown in the above Table 7, or some algorithm that looks at adjacent frames and determines the optimum tradeoff of redundancy bits between the adjacent frames.

According to one or more embodiments, considering the approach of FIG. 6, the coding types of Table 6, and the frame classification of Table 7, it may be desirable to add a constraint to the packet structure of FIG. 6 so transport speech frames with varying amounts of redundancy may be utilized based on the coding type or frame classification. In an embodiment, the constraint may be that the number of "A" class bits equals the number of "C" class bits.

Figure 9:
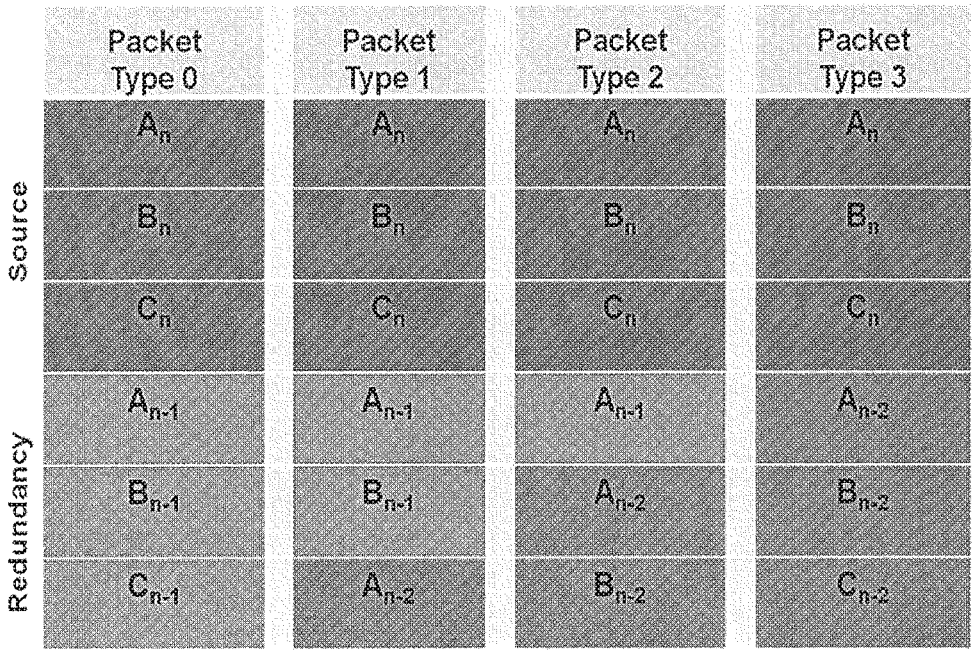
FIG. 9 illustrates four subtypes of packets available for use for unequal redundancy transport based upon a constraint that the number of A class bits equals the number of C class bits, according to one or more embodiments.

With this approach, four subtypes of packets can be used for redundancy transport, as shown in FIG. 9.

FIG. 9 illustrates four subtypes of packets available for use for redundancy transport based upon a constraint that the number of A class bits equals the number of C class bits, according to one or more embodiments.

In this example, packet type "1" of FIG. 9 is the same packet arrangement as that used in the redundancy transport of FIG. 6. For example, for packet N of FIG. 6, the encoded source bits for $A_n$, $B_n$, $C_n$, $A_{n-1}$, $B_{n-1}$, and $A_{n-2}$ are used.

FIG. 10 illustrates various packet subtypes providing enhanced protection to an onset frame, according to one or more embodiments.

Using a selection of a data packet subtype from the four packet subtypes of FIG. 9, encoded speech frames can be selected for higher or lower redundancy protection, depending on the perceptual importance of the particular frame. The use of the various packet subtypes to provide enhanced protection of an onset frame (at the expense of an adjacent frame) is illustrated in FIG. 10.

In the example of FIG. 10, packet N−1 contains an onset frame, a frame classification known to be highly sensitive to erasure from a perceptual perspective. The redundancy protection of frame n−1 is contained in packets N and N+1. Accordingly, packet N is chosen to be subtype 0 and packet N+1 is chosen to be subtype 3. This results in an enhanced redundancy protection of frame n−1.

As shown in FIG. 10, frame n−1 is transmitted in its entirety three consecutive times. This increased protection comes at the expense of protection of frame n−2 and frame n. Typically if frame n−1 is an onset, frame n−2 is an unvoiced frame, a frame type that needs less protection. According to one or more embodiments, use of four packet subtypes may require transmission of two signaling bits. As an example, these bits may be transmitted as class A FEC bits as shown in Table 3.

In view of the above, FIGS. 2A and 2B sets forth one or more terminals 200 that are configured to encode or decode audio data with an FEC algorithm presented herein. The terminals 200 may be implemented within the EPS and/or EVS codec 26 environment of FIG. 1. Alternative environments and codecs are equally available.

In addition, as the terminal 200 of FIG. 2B, one or more embodiments include a source terminal, receiver terminal, or intermediary encoding/decoding terminals that may perform the encoding and/or decoding operations, e.g., respectively as the encoding terminal 100, the decoding terminal 150, or in the network path between two terminals provided by network 140. One or more embodiments include terminals 200 that receive and/or transmit audio data in different protocols, e.g., through different network types, such as a landline telephone communication system to a cellular telephone or data communication network or wireless telephone or data communication network, as only examples. One or more embodiments of the terminal 200 include VOIP applications and systems, as well as remote conferencing applications and systems, through a real-time broadcasting and multicast broadcasting, and time-delayed, stored, or streamed audio applications and systems. The encoded audio data may be recorded for later playback, and decoded from a streamed broadcast or stored audio data.

One or more embodiments of the one or more terminals 200 include a landline telephone, a mobile phone, a personal digital assistant, a smartphone, a tablet computer, a set top box, a network terminal, a laptop computer, a desktop computer, server, router, or gateway, for example. The terminal 200 includes at least one processing device, such as a digital signal processor (DSP), Main Control Unit (MCU), or CPU, as only examples.

Depending on embodiment, the wireless network 140 is any of a Wireless Personal Area Network (WPAN) (such as through Bluetooth or IR communications), a Wireless LAN (such as in IEEE 802.11), a Wireless Metropolitan Area Network, any WiMax network (such as in IEEE 802.16), any WiBro network (such as in IEEE 802.16e), a network, a Global System for Mobile Communications (GSM), Personal Communications Service (PCS), and any 3GGP network, as only examples, as only non-limiting examples. The wired network can be any landline and/or satellite based telephone networks, cable television or internet access, fiber-optic communication, waveguide (electromagnetism), any Ethernet communication network, any Integrated Services Digital Network (ISDN) network, any Digital Subscriber Line (DSL) network, such as any ISDN Digital Subscriber Line (IDSL) network, any High bit rate Digital Subscriber Line (HDSL) network, any Symmetric Digital Subscriber Line (SDSL) network, any Asymmetric Digital Subscriber Line (ADSL) network, any local exchange carriers (ILECs) provision Rate-Adaptive Digital Subscriber Line (RADSL) network, any VDSL network, and any switched digital service (non-IP) and POTS system. A source terminal can be communicating with a network 140 that is different from the network 140 the receiving terminal communicates with, and audio data may be communicated through more than two different networks 140 with the terminal being at any point in a path between an audio source and an audio receiver 140. One or more embodiments include any encoding, transferring, storing, and/or decoding of audio data having the FEC information of one or more embodiments, and the audio data may be encased in a packet that is appropriate for the transport protocol carrying the audio data.

The transport protocol may be any protocol capable of supporting an RTP packet or HTTP packet, which may respectively have at least a header, table of contents, and payload data, as only an example, and may alternatively be any TCP protocol, UDP protocol, Cyclic UDP protocol, DCCP protocol, Fiber Channel Protocol, NetBIOS protocol, Reliable Datagram Protocol, RDP, SCTP protocol, Sequenced Packet Exchange (SPX), Structured Stream Transport (SST), VSP protocol, Asynchronous Transfer Mode (ATM), Multipurpose Transaction Protocol (MTP/IP), Micro Transport Protocol (μTP), and/or LTE, as only examples. One or more embodiments include a communication of a Quality of Service (QoS), e.g., to/from the decoding terminal 150 and an encoding terminal 100, and the QoS may be transmitted through any path or protocol, including RTCP or a separate path from the audio data transmission path, as only examples. The QoS may be determined based on error checking code included in the data packet. One or more embodiments include changing a coding bitrate and/or changing of coding modes while applying the FEC approach of one or more embodiments, including changing the FEC mode based on the QoS, for example.

One or more embodiments include using one or more thresholds to compare to the QoS to determine whether to apply the FEC approach of one or more embodiments, and/or what mode of the FEC approach of one or more embodiments should be applied. There may be more than one threshold for each comparison, including a threshold indicating that the FEC mode needs to be adjusted for more reliability, decreased or increased, if the QoS is < or <=Th1 and a threshold that indicates that the bit rate or FEC mode needs to be adjusted for less reliability, decreased or increased, if the QoS is > or >=Th2, within Th1 and Th2 being equal in an embodiment.

One or more embodiments include any audio codec used by the encoding terminal 100 and/or the decoding terminal 150 to code the audio data using the FEC approach of one or more embodiments, with the audio coding using one or more algorithms using LPC (LAR, LSP), WLPC, CELP, ACELP, A-law, μ-law, ADPCM, DPCM, MDCT, Bit rate control (CBR, ABR, VBR), and/or Sub-band coding, and may be any codec capable of incorporating the FEC approach of one or more embodiments, including AMR, AMR-WB (G.722.2), AMR-WB+, GSM-HR, GSM-FR, GSM-EFR, G.718, and any 3GPP codec, including any EVS codec, as only examples. In one or more embodiments, the used codec is backward compatible with at least a previous version of the codec. The encoded audio data packet produced by the encoding terminal 100 may include audio data encoded according to more than one codecs by encoder-side codec 120, and may include super wideband audio (SWB), which may be a mono signal that is downmixed by the encoder, binaural stereo audio data, which may also be downmixed by the encoder, full band audio (FB) and/or multi-channel audio. One or more embodiments include encoding one or more of the different types of audio data with the same or different bitrates. In one or more embodiments, the decoding terminal 150 is configured similarly to parse such an encoded audio data packet. Accordingly, one or more embodiments of the terminal 200 include a codec that performs a constant, multi-rate, and/or variable encoding, or translation within the communication path, and/or include a codec that performs any scalable coding, such as with multiple layers or enhancement layers, which may have the same sampling rate or different sampling rates. In one or more embodiments, the decoder includes a jitter buffer. The encoder-side codec 120 may include spatial parameter estimation and mono or binaural downmixing, and one or more of the above listed audio codecs to produce the one or more different audio data, and the decoder-side codec 150 may include corresponding codecs and a mono or binaural upmixing and spatial rendering based on a decoding of the estimated parameters.

In one or more embodiments, any apparatus, system, and unit descriptions herein include one or more hardware devices or hardware processing elements. For example, in one or more embodiments, any described apparatus, system, and unit may further include one or more desirable memories, and any desired hardware input/output transmission devices. Further, the term apparatus should be considered synonymous with elements of a physical system, not limited to a single device or enclosure or all described elements embodied in single respective enclosures in all embodiments, but rather, depending on embodiment, is open to being embodied together or separately in differing enclosures and/or locations through differing hardware elements.

In addition to the above described embodiments, embodiments can also be implemented through computer readable code/instructions in/on a non-transitory medium, e.g., a computer readable medium, to control at least one processing device, such as a processor or computer, to implement any above described embodiment. The medium can correspond to any defined, measurable, and tangible structure permitting the storing and/or transmission of the computer readable code.

The media may also include, e.g., in combination with the computer readable code, data files, data structures, and the like. One or more embodiments of computer-readable media include: magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Computer readable code may include both machine code, such as produced by a compiler, and files containing higher level code that may be executed by the computer using an interpreter, for example. The media may also be any defined, measurable, and tangible distributed network, so that the computer readable code is stored and executed in a distributed fashion. Still further, as only an example, the processing element could include a processor or a computer processor, and processing elements may be distributed and/or included in a single device.

The computer-readable media may also be embodied in at least one application specific integrated circuit (ASIC) or Field Programmable Gate Array (FPGA), as only examples, which execute (processes like a processor) program instructions.

While aspects of the present invention has been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed:

1. A method for encoding audio, the method comprising:

setting, performed by at least one processor, an operation mode of a codec, wherein the operation mode is associated with a high frame erasure rate (FER) condition; and adding partial redundant data of a current frame onto at least one neighboring frame, according to a coding mode.

2. The method of claim 1, wherein the High FER condition is used for an Enhanced Voice Services (EVS) codec of a 3GPP standard and the codec is the EVS codec.

3. The method of claim 2, wherein the EVS codec adds encoded audio from the at least one neighboring frame, including respectively encoded audio of one or more previous frames and/or one or more future frames, to results of the encoding of the current frame in a current packet for the current frame as combined EVS encoded source bits, with the combined EVS encoded source bits being represented in the current packet distinct from any RTP payload portion of the current packet, and wherein the EVS codec is configured to respectively encode audio from each of the at least one neighboring frame, as the encoded audio, and include the respectively encoded audio from each of the at least one neighboring frame in separate packets from the current packet.

4. The method of claim 1, wherein the codec adds a High FER condition flag to a current packet for the current frame to identify the operation mode for the current frame as being associated with the High FER condition.

5. The method of claim 4, wherein the High FER condition flag is represented in the current packet by a single bit in the RTP payload portion of the current packet.

6. The method of claim 1, wherein the codec adds a frame erasure concealment (FEC) mode flag to a current packet for the current frame identifying which one of one or more FEC modes is selected for the current frame.

7. The method of claim 6, wherein the FEC mode flag is represented in the current packet by only two bits.

8. The method of claim 7, wherein the codec adds the FEC mode flag for the current frame with redundancy data in packets of other frames.

9. The method of claim 1, wherein, the setting comprises setting the operation mode with different, increased, and/or varied partial redundant data compared to other modes of a plurality of operation modes based upon an analysis of feedback information including at least one of quality of transmission determined outside the terminal, a determination that the current frame is more sensitive to frame erasure upon transmission, and an importance of the current frame.

10. The method of claim 9, wherein the feedback information comprises at least one of: fast feedback (FFB) information, a hybrid automatic repeat request (HARQ) feedback transmitted at a physical layer; slow feedback (SFB) information, feedback from network signaling transmitted at a layer higher than the physical layer; in-band feedback (ISB) information, in-band signaling from the a codec at a far end; and high sensitivity frame (HSF) information, a selection by the codec of specific critical frames to be sent in a redundant fashion.

11. The method of claim 1, wherein, the setting comprises setting the operation mode to be associated with a frame error concealment (FEC) mode of one or more FEC modes based upon one of a determined coding type of at least one of the current frame and neighboring frames, from a plurality of available coding types, or a determined frame classification of at least one of the current frame and the neighboring frames, from a plurality of available frame classifications.

12. The method of claim 11, wherein the plurality of available coding types comprise an unvoiced wideband type for unvoiced speech frames, a voiced wideband type for voiced speech frames, a generic wideband type for non-stationary speech frames, and a transition wideband type used for enhanced frame erasure performance.

13. The method of claim 11, wherein the plurality of available frame classifications comprise an unvoiced frame classification for unvoiced, silence, noise, voiced offset, an unvoiced transition classification for transition from unvoiced to voiced components, a voiced transition classification for transition from voiced to unvoiced components, a voiced classification for voiced frames and the previous frame was also a voiced or classified as an onset frame, and an onset classification for voiced onset being sufficiently well established to follow with a voice concealment by a decoder.

14. The method of claim 1, wherein the High FER condition is identified in response to a frame error rate being greater than a threshold.

15. The method of claim 1, wherein the High FER condition is identified based on a network condition.

16. The method of claim 1, further comprising:

transmitting the current frame to a receiver, wherein information about the High FER condition is received from the receiver.

17. The method of claim 1, wherein a size of the partial redundant data is determined based on signal characteristics.

18. The method of claim 1, wherein the setting comprises setting the operation mode to one sub-mode of a plurality of sub-modes based on at least one of network bandwidth and an amount of frame error concealment, wherein the codec is configured to add the partial redundant data based on the one sub-mode of the plurality of sub-modes.

19. A non-transitory computer readable medium comprising computer readable code executable by a processor to perform the method of claim 1.

* * * * *